US005953985A

United States Patent [19]

Kobayashi

[11] Patent Number: 5,953,985

[45] Date of Patent: Sep. 21, 1999

[54] STENCIL PRINTER

[75] Inventor: Kazuyoshi Kobayashi, Murata-machi, Japan

[73] Assignee: Tohoku Ricoh Co., Ltd., Miyagi-ken, Japan

[21] Appl. No.: 08/782,920

[22] Filed: Jan. 13, 1997

[30] Foreign Application Priority Data

Jan. 18, 1996 [JP] Japan ..... 8-006275
Mar. 25, 1996 [JP] Japan ..... 8-067552

[51] Int. Cl.[6] ..... B41L 13/06

[52] U.S. Cl. ..... 101/116; 101/127.1; 271/273; 271/275

[58] Field of Search ..... 101/114, 116, 101/117, 118, 119, 120, 127.1, 128.1, 129, 477, 226, 227; 271/251, 272, 273, 275

[56] References Cited

U.S. PATENT DOCUMENTS 4,419,003 12/1983 Fujie et al. ..... 271/251

FOREIGN PATENT DOCUMENTS 60-21243 6/1985 Japan .
60-119565 8/1985 Japan .
61-30866 9/1986 Japan .
62-20297 5/1987 Japan .
5-162429 6/1993 Japan .
6-227110 8/1994 Japan .
6-293176 10/1994 Japan .
7-17013 1/1995 Japan .
7-125399 5/1995 Japan .

*Primary Examiner*—Ren Yan
*Attorney, Agent, or Firm*—Oblon, Spivak, McClelland, Maier & Neustadt, P.C.

[57] ABSTRACT

In a stencil printer including a rotatable drum for wrapping a perforated stencil or master therearound, a pair o f inclined tension rollers are movable into and out of contact with the drum in order to smooth a creased master. The distance between the tension rollers sequentially increases from the upstream side toward the downstream side with respect to an intended direction of master transport. While the master is sequentially wrapped around the drum, the tension rollers pull the opposite side edges of the master outward. At the same time, the elastic member presses the intermediate portion of the master. The tension rollers and elastic member cooperate to smooth the master. The elastic member is located at a position not closer to the drum than a position around a line connecting the points of the tension rollers contacting the master, and where it can contact the intermediate portion of the master.

11 Claims, 14 Drawing Sheets

STENCIL PRINTER

BACKGROUND OF THE INVENTION

The present invention relates to a stencil printer or similar printer.

Today, a stencil printer is extensively used to form images on sheets and has a thermal head having a number of heating elements arranged in the main scanning direction.

While a stencil is conveyed in the subscanning direction in contact with the thermal head, the heating elements selectively generate heat in accordance with image data so as to form perforations or dots in the stencil. Then, the perforated stencil or master is wrapped around a rotatable drum. A sheet is fed toward the drum such that it meets the master wrapped around the drum. When the sheet is pressed against the drum via the master, ink is transferred from the inside of the drum to the sheet via pores formed in the drum and the perforations of the master, forming an image on the sheet. The drum is made up of a hollow cylindrical body having a number of pores formed in its circumferential wall, and a laminate mesh screen covering the cylindrical body and formed of resin or metal. The stencil has a laminate structure comprising an about 1 $\mu$m to 2 $\mu$m thick thermoplastic resin film and a porous support formed of Japanese paper or a mixture of Japanese paper and synthetic fibers.

The problem with the stencil printer is that the master is apt to slacken when wrapped around the drum. When a press roller or similar pressing member presses the sheet against the drum via the master, it crushes the slack and thereby causes the master to crease. This lowers the quality of an image printed on a sheet. To free the master from creases, it has been customary to provide the master with elasticity high enough for the master to move on the outer periphery of the drum when pressed against the drum, overcoming the viscosity of the ink. This successfully straightens the slackened master and thereby prevents the master from being creased. This is why the stencil is made up of the thermoplastic resin film and porous support.

However, the stencil having such high elasticity brings about the following problem. Assume that the porous support includes masses where Japanese paper or synthetic resins are entangled, or that thick fibers traverse the perforations of the master. Then, the ink is prevented from exuding via the master at such masses or perforations. As a result, an image printed on a sheet has its solid portion locally lost, has its thin lines disconnected, or has its thick lines blurred. That is so-called fiber marks appear on the printed image and degrade the image.

To reduce the fiber marks, the stencil may be implemented only by the thermoplastic resin film or may have its porous support of Japanese paper or synthetic fibers thinned. However, a stencil consisting only of the thermoplastic resin film or having a thin porous support has low elasticity. When this kind of stencil is heated for perforation, the resin film contracts and causes the stencil t o crease. Further, assume that the stencil or master with low elasticity and wrapped around the drum has a slack. Then, when the sheet is pressed against the drum via the master, the master fails to move on the outer periphery of the drum due to the viscosity of the ink. As a result, the slack of the master is crushed, causing the master to crease. Moreover, in a stencil printer of the type causing conveyor rollers to convey a stencil toward a drum while perforating the stencil, the stencil is prevented from waving due to its own elasticity during conveyance. Therefore, the stencil of low elasticity cannot be prevented from waving, so that it wraps around the drum without being straightened. Again, such a stencil or master wrapped around the drum is apt to slacken and therefore crease.

As for the laminate stencil made up of the resin film and porous support, even when the sheet is pressed against the drum by the pressing member via the master, the master is capable of sliding on the drum, overcoming the viscosity of the ink. Therefore, such a master creases little.

Stencil printers using the stencil consisting only of the thermoplastic resin film, but capable of smoothing it when wrapping it around the drum, have been proposed in, e.g., Japanese Utility Model Publication Nos. 60-21243 and 61-30866 and Japanese Utility Model Laid-Open Publication No. 60-119565. The printers disclosed in these documents each includes a stencil mounting device for straightening the slackened or creased stencil to be fed to the drum. The stencil mounting device has a guide for guiding the stencil to the drum, and a rotatable stretching member contacting the guide via the stencil. While the stencil is in movement, the stretching member is rotated by the stencil while exerting tension on the stencil in the widthwise direction of the stencil. In this type of stencil printer, the stencil is paid out from the stencil mounting device and fed toward the drum due to the rotation of the drum. At this instant, in the stencil mounting device, the stencil is conveyed along the guide member while being subjected to the tension ascribable to the stretching member. Consequently, the stencil can wrap around the drum without any slack or crease.

However, the conventional stencil printer using the guide member and stretching member has some problems yet to be solved, as follows. While the drum is in rotation, the stencil is sequentially paid out via a nip between the guide member and the stretching member. At this instant, tension acts on the stencil between the above nip and the drum. As a result, if the stencil has low elasticity, then it extends in the direction of stencil transport and creases in the lengthwise direction.

Further, the nip between the guide member and the stretching member is remote from the drum. So long as the master has high elasticity, the trailing edge of the master pulled out from the nip can wrap around the drum without slackening because the master is prevented from waving due to its own elasticity. However, when the master has low elasticity, the trailing edge of the master pulled out from the nip waves and wraps around the drum without being straightened, resulting in a slack. The slack would be crushed and would cause the master to crease, as stated earlier.

Japanese Utility Model Publication No. 62-20297 proposes a stencil printer including an elastic member whose upstream edge with respect to the direction of master transport is sequentially inclined from its intermediate portion to opposite sides in the above direction. With this configuration, the elastic member smooths the stencil outward in the widthwise direction of the stencil. Further, Japanese Patent Laid-Open Publication No. 7-125399 discloses a stencil printer in which a roller presses the master against the drum over the entire width of the master.

SUMMARY OF THE INVENTION

It is therefore an object of the present invention to provide a printer capable of preventing a master from creasing or waving when wrapping it around the drum.

It is another object of the present invention to provide a printer capable of preventing a master from creasing even when the master has low elasticity.

In accordance with the present invention, a printer for printing an image on a sheet includes a rotatable drum for wrapping a perforated master therearound. A sheet is so fed as to meet the master wrapped around the drum and is pressed against the drum to transfer ink to the sheet. A pair of rotatable tension rollers face the opposite sides of the master in the widthwise direction of the master, and are movable toward and away from the drum. The tension rollers are inclined with respect to the intended direction of master transport such that the distance between them sequentially increases from the upstream side toward the downstream side with respect to the intended direction of master transport.

Also, in accordance with the present invention, in a printer for wrapping a perforated master around a drum, feeding a sheet to the outer periphery of the drum such that the sheet meets the perforated master, pressing the sheet against the drum via the master, and transferring ink from the master wrapped around the drum to the sheet to thereby print an image on the sheet, a pair of tension rollers face the opposite sides of the master in the widthwise direction of the master, and are rotatable, due to friction acting between the master being pulled by the drum in rotation and the tension rollers, about their axes which are inclined with respect to the widthwise direction of the master, thereby pulling the master outward in the widthwise direction. An elastic member is located at a position not closer to the drum than a position around a line connecting the points of the tension rollers contacting the master, and where the elastic member can contact the intermediate portion of the master in the widthwise direction. A drive mechanism selectively moves the tension rollers and elastic member into or out of contact with the master.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
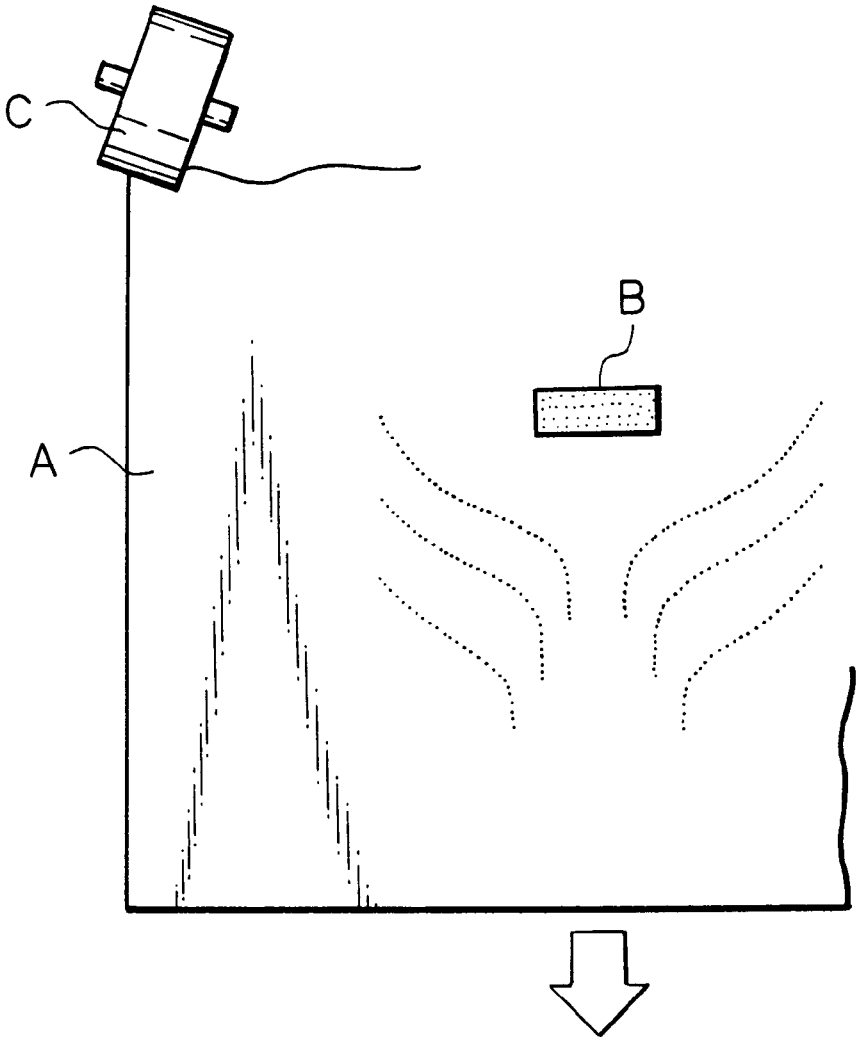
Fig. 1 PRIOR ART
FIG. 1 is a plan view showing a position where an inclined roller and an elastic member included in a conventional stencil printer contact a master.

To better understand the present invention, a brief reference will be made to a conventional stencil printer, shown in FIG. 1. The stencil printer to be described is of the type taught in Japanese Utility Model Publication No. 60-21243 mentioned earlier. As shown, the printer includes an elastic member B and an inclined roller C. A stencil or master A is conveyed in the direction indicated by an arrow in FIG. 1. The elastic member B is located downstream of the inclined roller C with respect to the direction in which the master A is conveyed. After the master A has moved away from the inclined roller C, it is pressed only by the elastic member B. At this instant, the opposite side edges of the master A are released from the inclined roller C and another inclined roller, not shown, while only the intermediate portion of the master A is stretched by the elastic member B. This brings about a problem that the master A creases at the intermediate portion longitudinally and obliquely. This is particularly true when the area of an image formed in the master A is great, because the elasticity of the master A decreases with an increase in the density o f dots formed in the master A.

Preferred embodiments of the stencil printer in accordance with the present invention will be described hereinafter.

1st Embodiment

Figure 2:
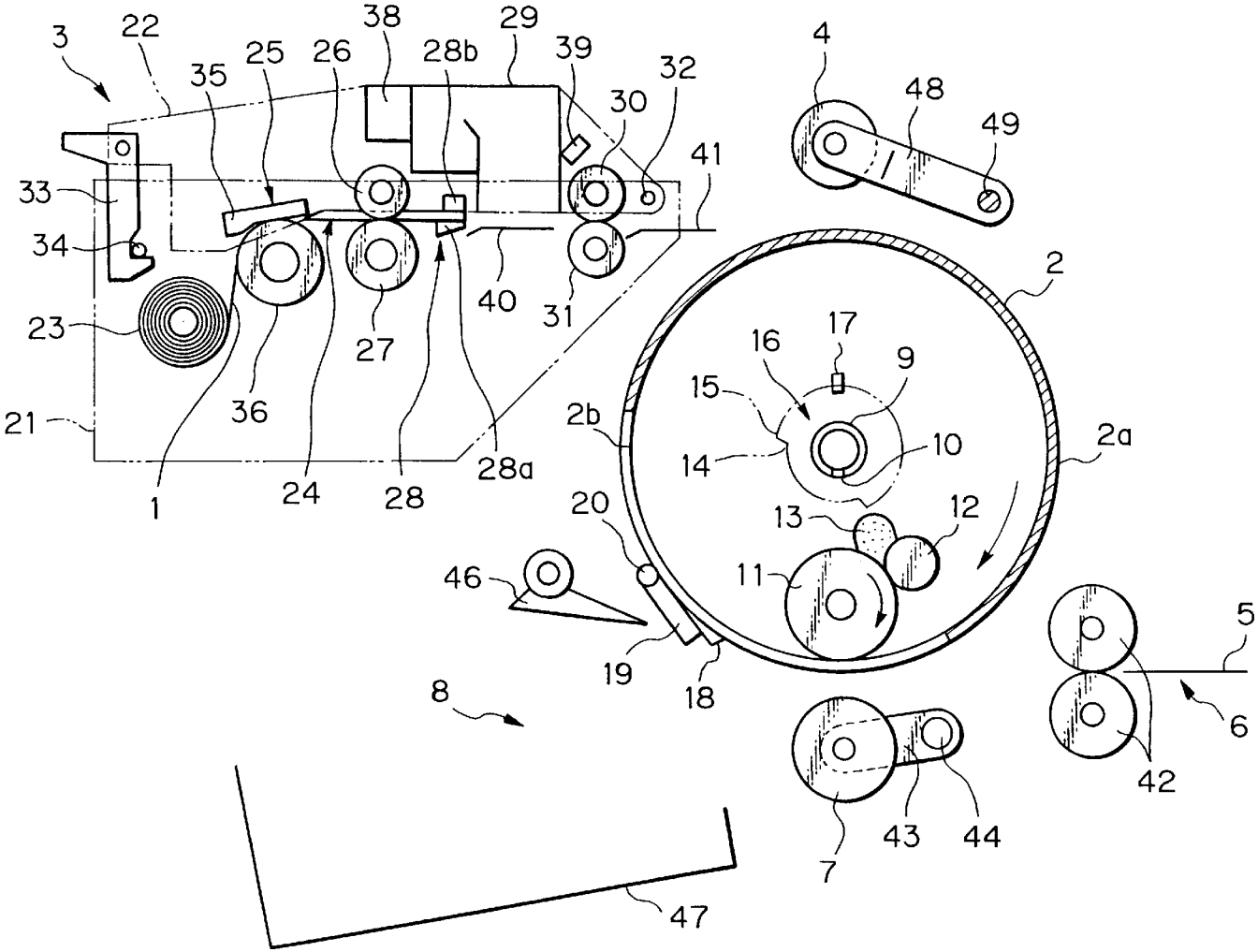
FIG. 2 is a sectional front view showing a first embodiment of the stencil printer in accordance with t h e present invention.

Referring to FIGS. 2–8, a stencil printer embodying the present invention is shown. As shown in FIG. 2, the printer includes a rotatable drum 2. Arranged around the drum are a master making section 3, an inclined tension roller 4, a sheet feeding section 6, a press roller 7, and a sheet discharging section 8. The master making section 3 cuts or perforates a stencil 1 by heating it and feeds the perforated stencil or master 1 to the drum 2. The tension roller 4 presses the master 1 against the drum 2 while exerting tension on the master 1 in the widthwise direction of the master 1. The sheet feeding section 6 feeds a sheet 5 such that its leading edge meets the leading edge of the master 1 wrapped around the drum 2. The press roller 7 presses the sheet 5 against the drum 2 via the master 1, so that an image is printed on the sheet 5. The sheet discharging section 8 separates the sheet 5 carrying the image thereon from the drum 2 and stacks it on a tray 47.

The drum 2 has a porous hollow cylindrical support and a laminate mesh screen wrapped around the support. The support has a porous portion 2*a* and a non-porous portion 2*b*.

The mesh screen is formed of resin or metal. The drum 2 is rotatable about an ink pipe 9 which is formed with holes 10 in its bottom portion. An ink pack, not shown, is located at the outside of the drum 2. An ink pump, not shown, pumps ink from the ink pack and delivers it to the ink pipe 9. As a result, the ink is fed to the inside of the drum 2 via the holes 10 of the ink pipe 9. A rotatable ink roller 11 is positioned below the ink pipe 9. The ink dropped from the ink pipe 9 is held by the ink roller 11 and fed to the inner periphery of the drum 2. A rotatable doctor roller 12 faces the ink roller 11 and is spaced from the roller 11 by a preselected small gap. The doctor roller 12 maintains the amount of irk deposited on the ink roller 11 constant. The ink roller 11 and doctor roller 12 form a wedge-like space therebetween. The ink dropped from the ink pipe 9 collects in the above space and forms an ink well 13.

A disk-like screen 16 is affixed to one end wall of the drum 2. The circumference of the screen 16 is made up of a larger diameter portion or screening portion 15 and a smaller diameter portion or notch 14. The larger diameter portion 15 and smaller diameter portion 14 respectively face the porous portion 2*a* and non-porous portion 2*b* of the drum 2. A screen sensor 17 is implemented by a light emitting element and a light-sensitive element and located above the ink pipe 9. The screen sensor 17 is positioned such that the screening portion 15 of the screen 16 obstructs the optical path between the two elements constituting the sensor 17, but the notch 14 does not obstruct it. In this position, the screen sensor 17 determines which of the notch 14 and screening portion 15 is facing the tension roller 4.

A stage 18 and a damper 19 are mounted on the outer periphery of the non-porous portion 2*b* of the drum 2, and cooperate to clamp the leading edge of the master 1. The stage 18 is formed of a magnetic material and extends in the axial direction of the drum 2. The damper 19 is rotatable about a shaft 20 extending along the stage 18.

The master making section 3 has a casing affixed to the housing of the printer and made up of a stationary portion 21 and an openable portion 22 mounted on the stationary portion 21. A stencil in the form of a roll 23 is removably and rotatably supported by the stationary portion 21. A transport path 24 is formed between the stationary portion 21 and the openable portion 22. While the openable portion 22 is in its closed position, i.e., rests on the stationary portion 21, the stencil 1 paid out from the roll 23 is conveyed toward the drum 2 along the transport path 24. A perforating section 25, an upper and a lower tension roller 26 and 27, a cutter 28, a suction box 29, and an upper and a lower conveyor roller 30 and 31 are sequentially arranged along the transport path 24 in the direction in which the stencil 1 is conveyed. The perforating section 25 perforates the stencil 1 by heat while pulling it out of the roll 23. The tension rollers 26 and 27 cooperate to convey the stencil 1 while exerting a preselected degree of tension on the stencil 1. The cutter 28 has a stationary edge 28*a* and a movable edge 28*b* and cuts the perforated stencil 1 at a predetermined length. The suction box 29 temporarily accommodates the stencil 1 by suction. The conveyor rollers 30 and 31 convey the stencil 1 toward the drum 2.

Figure 3:
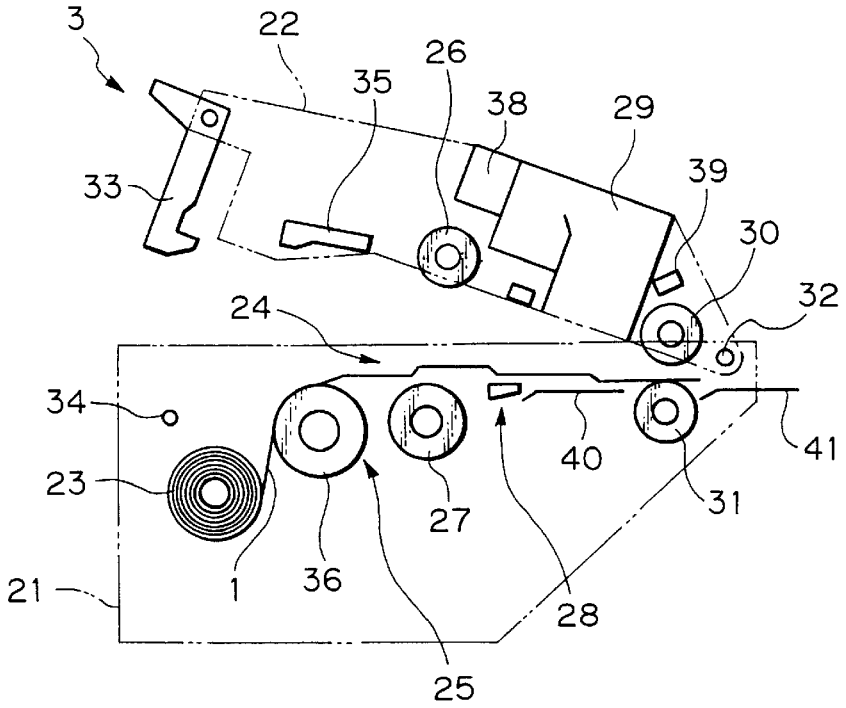
FIG. 3 is a sectional front view showing an openable portion included in the first embodiment opened away from a stationary portion.

As shown in FIG. 3, the openable portion 22 is openable, or rotatable, away from the stationary portion 21 about a shaft 32 which is formed on the portion 21 at the downstream side with respect to the transport path 24. A stop 33 is rotatably mounted on the openable portion 22 and used to lock the portion 22 to the portion 21. The stop 33 is engageable with an engaging portion 34 formed on the stationary portion The perforating section 25 has a thermal head 35 for perforating the stencil 1, and a platen roller 36 for pressing the stencil 1 against the thermal head 35 while pulling it out of the roll 23. The head 35 is affixed to the openable portion 22 while the platen roller 36 is rotatably supported by the stationary portion 21. A stepping motor 37 (see FIG. 6) is drivably connected to the platen roller 36. The head 35 has a number of heating elements arranged thereon in the main scanning direction.

The tension rollers 26 and 27 are held in pressing contact with each other and respectively supported by the openable portion 22 and stationary portion 21. The stepping motor 37 is drivably connected to the lower tension roller 27 via a torque limiter, not shown. In this condition, the tension roller 27 is caused to rotate at a higher peripheral speed than the platen roller 36. As a result, a preselected degree o f tension acts on the stencil 1 between the perforating section 25 and the roller pair 26 and 27.

The stationary edge 28*a* and movable edge 28*b* constituting the cutter 28 are affixed to the stationary portion 21 and openable portion 22, respectively. A motor, not shown, drives the movable edge 28*b*, or rotary edge 28*b* in the illustrative embodiment. The movable edge 28*b* and motor are movable on and along guide rails, not shown, in the widthwise direction of the transport path 24.

The suction box 29 is removably mounted on the openable portion 22 and is formed with an opening facing the transport path 24. A suction fan 38 is mounted on the upstream wall of the box 29 with respect to the transport path 24 in order to suck the master 1 into the box 29. A master sensor 39 is located downstream of the box 29 with respect to the transport path 24 and faces the box 29 in order to sense the master 1 sucked into the box 29. A first guide plate 40 is positioned below the opening of the box 29 for guiding the stencil 1. The first guide plate 40 is affixed to the stationary portion 21.

The conveyor rollers 30 and 31 are also held in pressing contact with each other. The upper roller 30 and lower roller 31 are mounted on the openable portion 22 and stationary portion 21, respectively. The stepping motor 37 is drivably connected to the lower roller 31. The lower roller 31 is caused to rotate at a higher peripheral speed than the lower tension roller 27. As a result, a preselected degree of tension acts on the stencil 1 between the tension rollers 26 and 27 and the conveyor rollers 30 and 31. A second guide plate 41 is positioned downstream of the conveyor rollers 30 and 31 in order to guide the stencil 1.

Referring again to FIG. 2, the sheet feeding section 6 includes a tray, not shown, loaded with a stack of sheets 5. The sheets 5 are fed from the tray to a registration roller pair 42 one by one. The registration roller pair 42 conveys the sheet 5 such that the leading edge of the sheet 5 meets the leading edge of the master 1 wrapped around the drum 2.

The press roller 7 is made up of a metallic core and an elastic body covering the surface of the core. For the elastic body, use may be made of nitrile rubber or chloroprene rubber. The press roller 7 is rotatably mounted on one end of a press roller arm 43 and movable into and out of contact with the drum 2. The press roller arm 43 is movably mounted on a shaft 44. A cam follower, not shown, is mounted on the shaft 44. A cam, not shown, contacts the cam follower and rotates in synchronism with the drum 2 in order to bring the press roller 7 into or out of contact with the drum 2. A spring, not shown, constantly biases the arm 43 clockwise such that the press roller 7 tends to contact the drum 2. A locking portion 45 (see FIG. 6) is located in the vicinity of the arm 43 and selectively engageable with the arm 43 to maintain it spaced from the drum 2.

The sheet discharging section 8 includes a separator 46 movable toward the drum 2 in order to separate the sheet 5 from the drum 2. The sheet 5 separated from the drum 2 is stacked on the previously mentioned tray 47.

Figure 4:
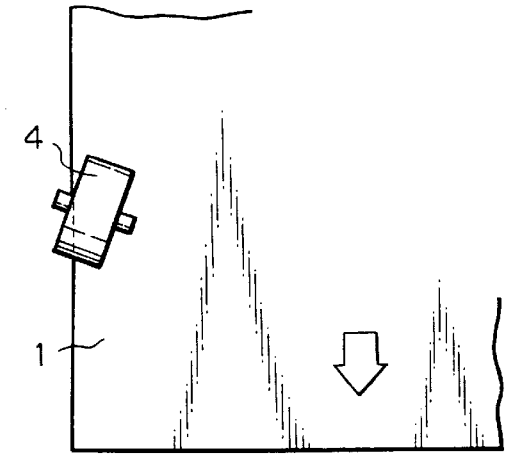
FIG. 4 is a plan view showing a positional relation between an inclined tension roller included in the first embodiment and a master.
Figure 5:
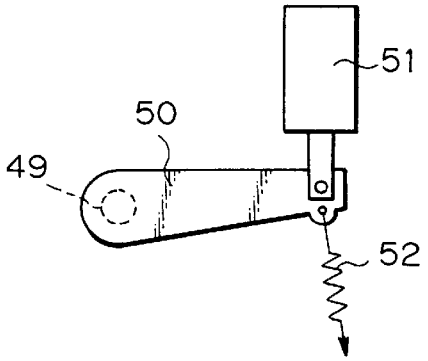
FIG. 5 is a front view showing a drive section included in the first embodiment for causing the tension roller to move into and out of contact with a drum.

The tension roller 4 is made up of a metallic core and a layer of soft silicone rubber covering the surface of the core. The soft silicone rubber is a viscous elastic material having a higher coefficient of friction than the drum 2. The tension roller 4 is rotatably mounted on one end of a tension roller arm 48 and movable into and out of contact with the drum 2. The tension roller 4 is positioned substantially just above the drum 2. Specifically, two tension rollers 4 are so positioned as to respectively face the opposite edges of the stencil 1 in the widthwise direction of the stencil 1. As shown in FIG. 4, the tension rollers 4 (only one is shown) are inclined with respect to the direction of master transport (downward as viewed in FIG. 4) such that the distance between the rollers 4 sequentially increases toward the downstream side in the above direction. As shown in FIG. 2, the tension roller arm 48 is rotatable about a shaft 49 formed at the other end thereof remote from the tension roller 4. As shown in FIG. 5, a lever 50 is affixed to the shaft 49. A solenoid 51 has its plunger connected to the lever 50. When the solenoid 51 is energized, it causes the lever 50 to rotate counterclockwise and thereby brings the tension rollers 4 into contact with the drum 2 via the stencil 1. A spring 52 is anchored at one end to the lever 50 and constantly biases the lever 50 clockwise, so that the tension roller 4 tends to move away from the drum 2. A tension roller motor or drive means 53 (see FIGS. 6 and 8) is drivably connected to the tension roller 4 and causes it to rotate at a higher peripheral speed than the drum 2. Specifically, the motor 53 causes the two tension rollers 4 facing the opposite side edges of the stencil 1 to rotate in synchronism with each other.

Figure 6A:
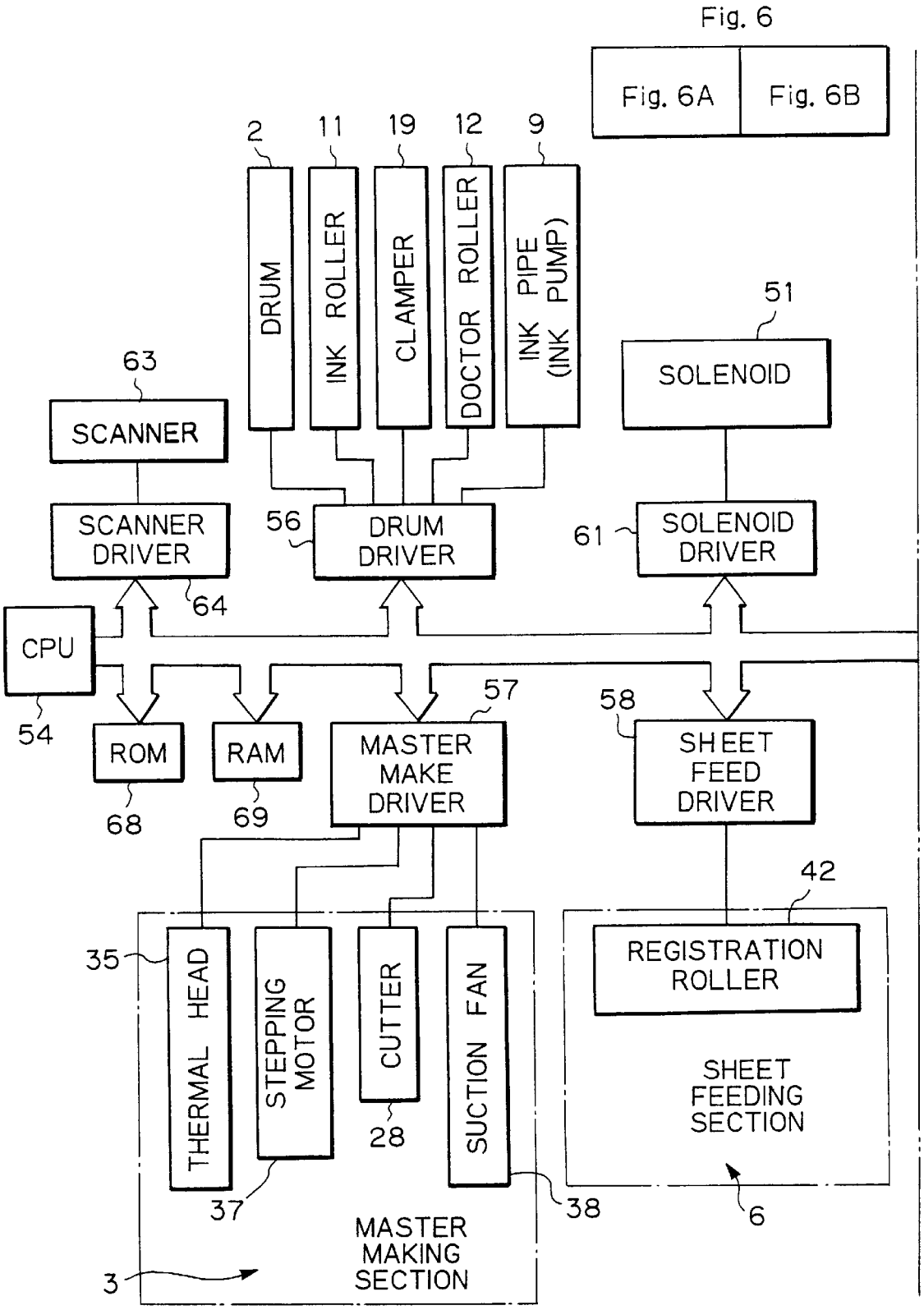
FIG. 6 is a block diagram schematically showing an electrical hardware arrangement included in the f i r s t embodiment.
Figure 6B:
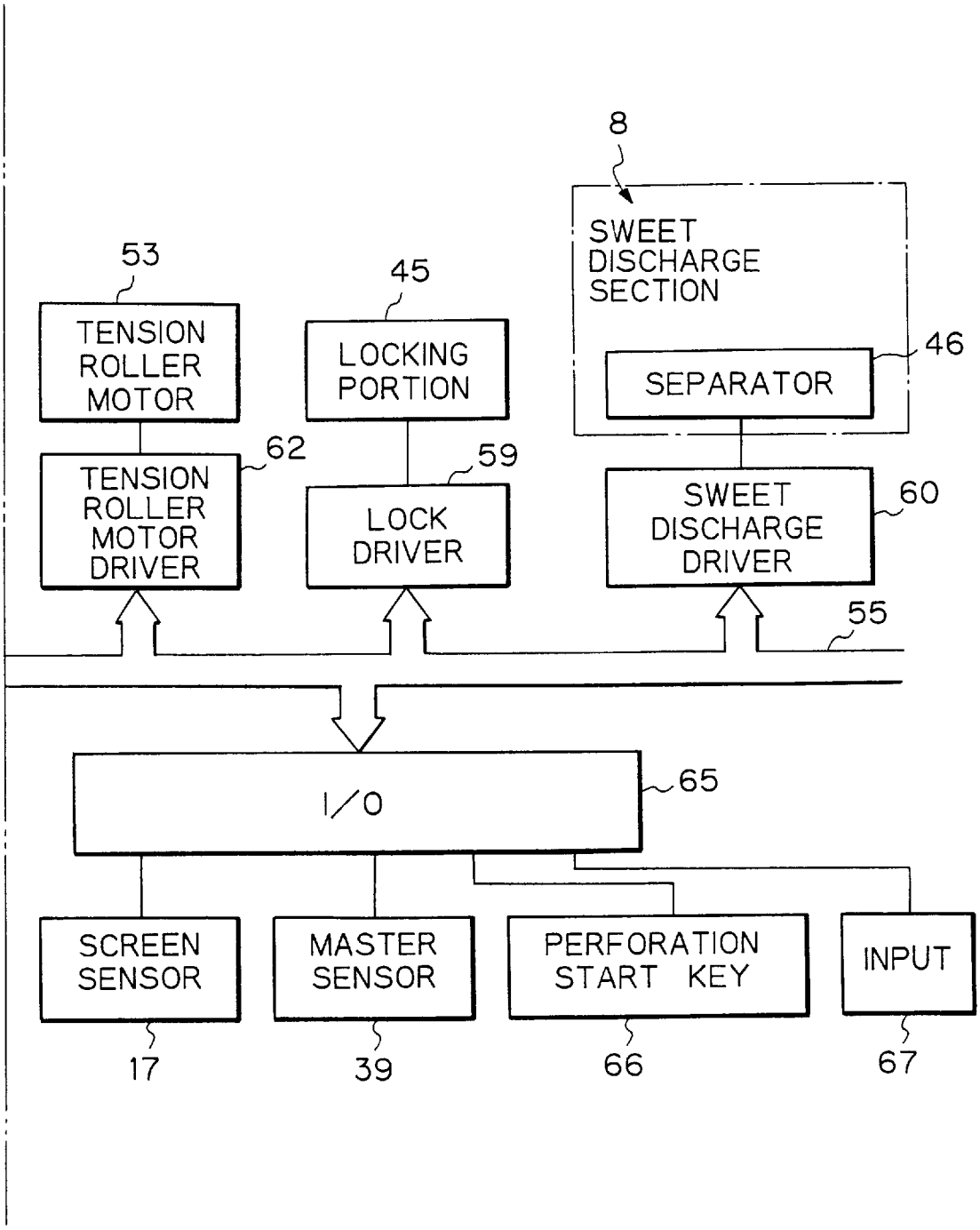

A reference will be made to FIG. 6 for describing electrical hardware particular to the illustrative embodiment. As shown, a CPU (Central Processing Unit) 54 controls the operation of the drum 2, master making section 3, tension rollers 4, sheet feeding section 6, press roller 7, and sheet discharging section 8. A drum driver 56, a master make driver 57, a sheet feed driver 58, a lock driver 59, a sheet discharge driver 60, a solenoid driver 61, a tension roller motor driver 62 and a scanner driver 64 are connected to the CPU 54 by a bus 55. The drum driver 56 drives the drum 2, the ink pipe 9 or ink pump, ink roller 11, doctor roller 12 disposed in the drum 2, and the damper 19. The master make driver 57 drives the cutter 28, thermal head 35, stepping motor 37 and suction fan 38 included in the master making section 3. The sheet feed driver 58 drives the registration roller 42 included in the sheet feeding section 6. The lock driver 59 drives the locking portion 45 assigned to the press roller 7. The sheet discharge driver 60 drives the separator 46 included in the sheet discharging section 8. The solenoid driver 61 drives the solenoid 51 for actuating the tension rollers 4. The tension roller motor driver 62 drives the tension roller motor 53. The scanner driver 64 drives an image reading or scanning section 63 which reads an image out of a document.

An I/O (Input/Output) port 65 is connected to the CPU 54 by the bus 55. Connected to the I/O port 65 are the screen sensor 17, master sensor 39, a perforation start key 66, and an input section 67. The input section 67 is used to set a number of rotations of the drum 2 to be effected with the tension rollers 4 contacting the drum 2 via the master 1, i.e., a period of time during which the rollers 4 exert the tension on the stencil 1 in the widthwise direction of the stencil 1.

A ROM (Read Only Memory) 68 and a RAM (Random Access Memory) 69 are also connected to the CPU 54 by the bus 55. The ROM 68 stores fixed information relating to the control over the various sections stated above. The RAM 69 temporarily stores information input from the screen sensor 17, master sensor 39, image reading section 63, perforation start key 66, and input section 67. Specifically, the ROM 68 stores information for determining the amount of an image to be printed on the sheet 5 on the basis of the area of perforations to be formed in a single master 1. The area of perforations is, in turn, determined on the basis of image information read by the image reading section 63. In addition, the ROM 68 stores information for setting the number of rotations of the drum 2, i.e., the above period of time on the basis of the amount of an image determined. The CPU 54 and the image amount information stored in the ROM 68 constitute means for determining the amount of an image to be printed on the sheet 5. Also, the CPU 54 and the rotation number information stored in the ROM 68 constitute means for setting the number of rotations of the drum 2 to be effected as stated above.

Figure 7A:
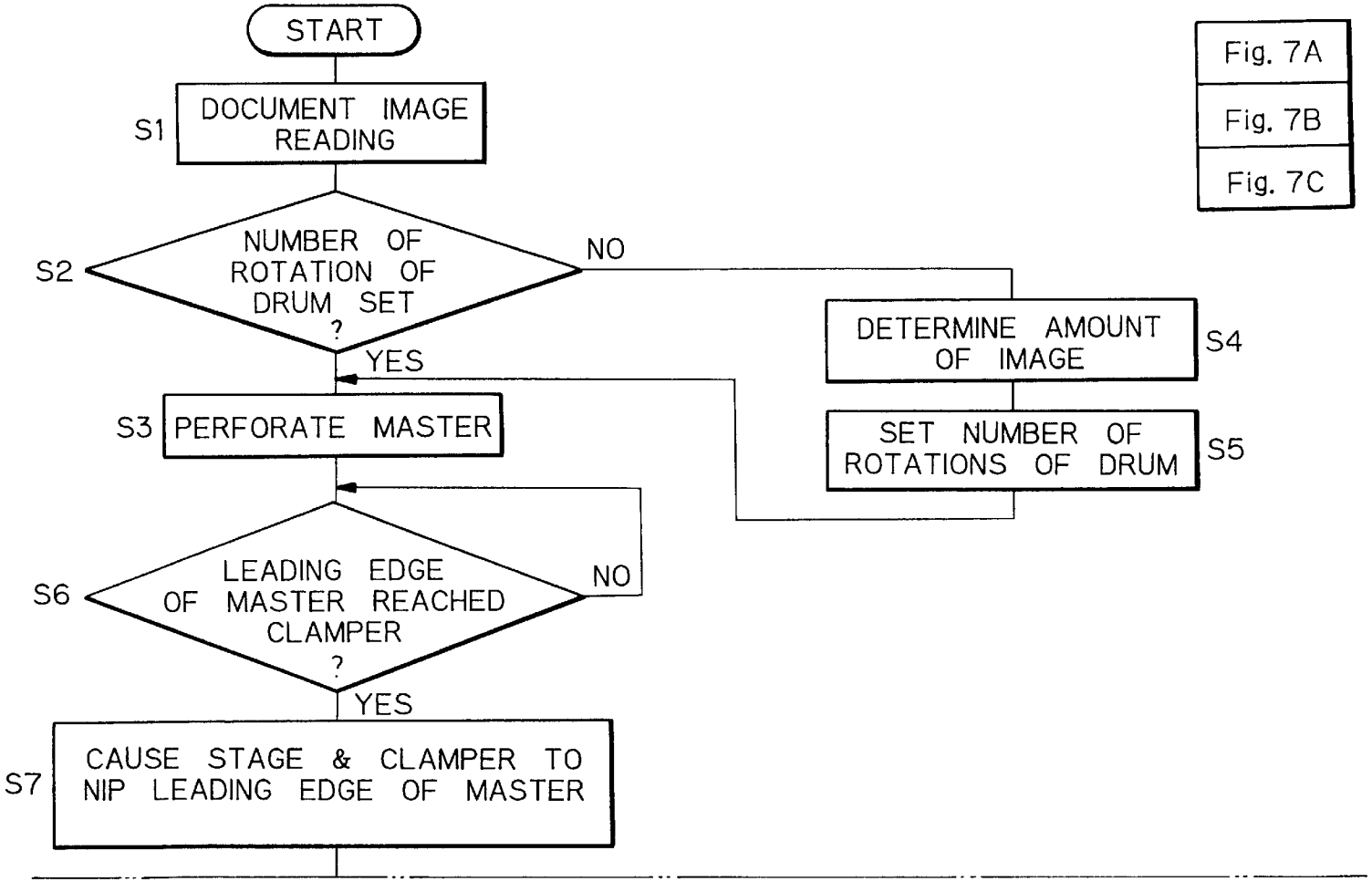
FIG. 7 is a flowchart demonstrating a specific master making operation available with the first embodiment.
Figure 7B:
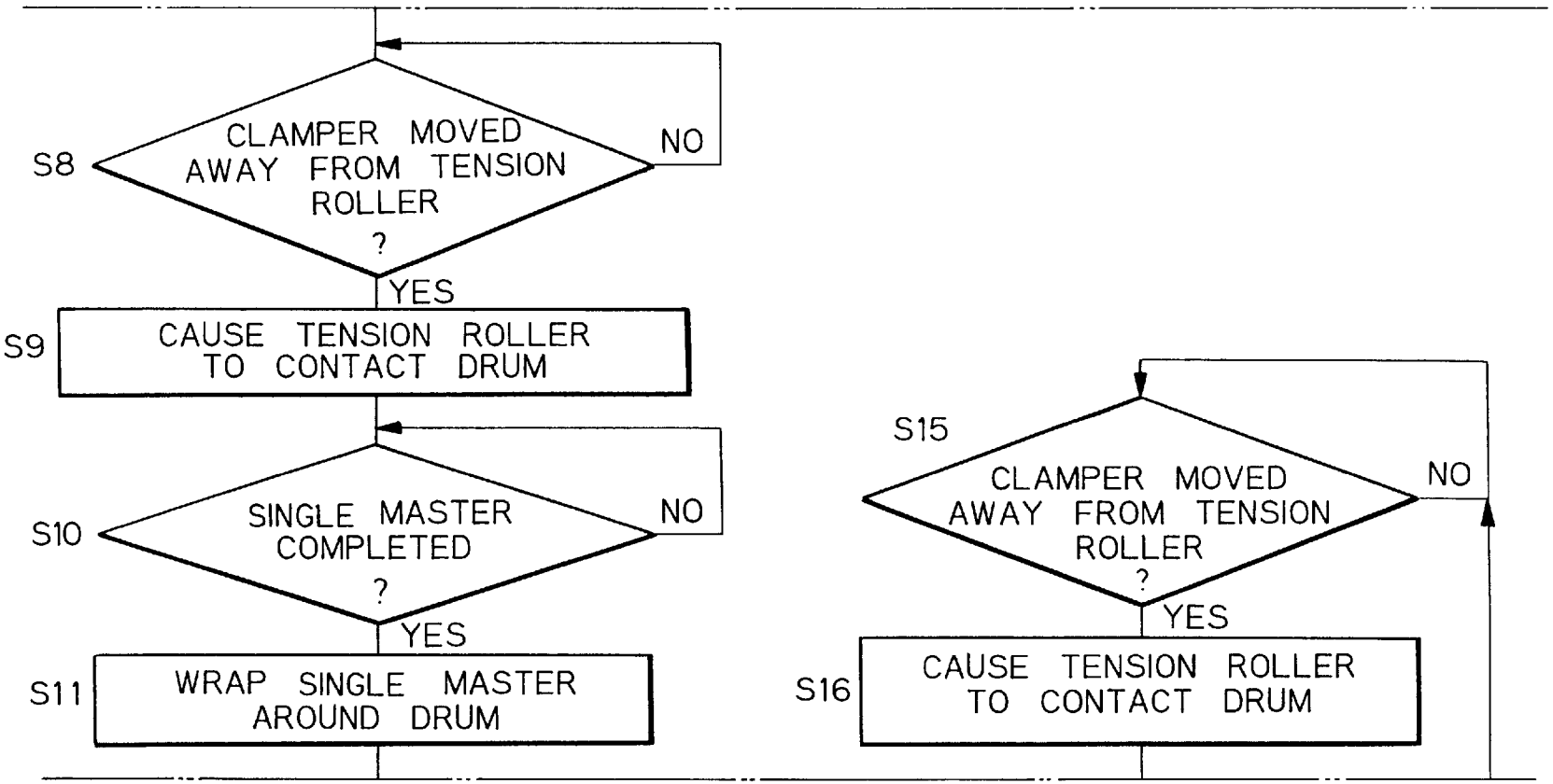
Figure 7C:
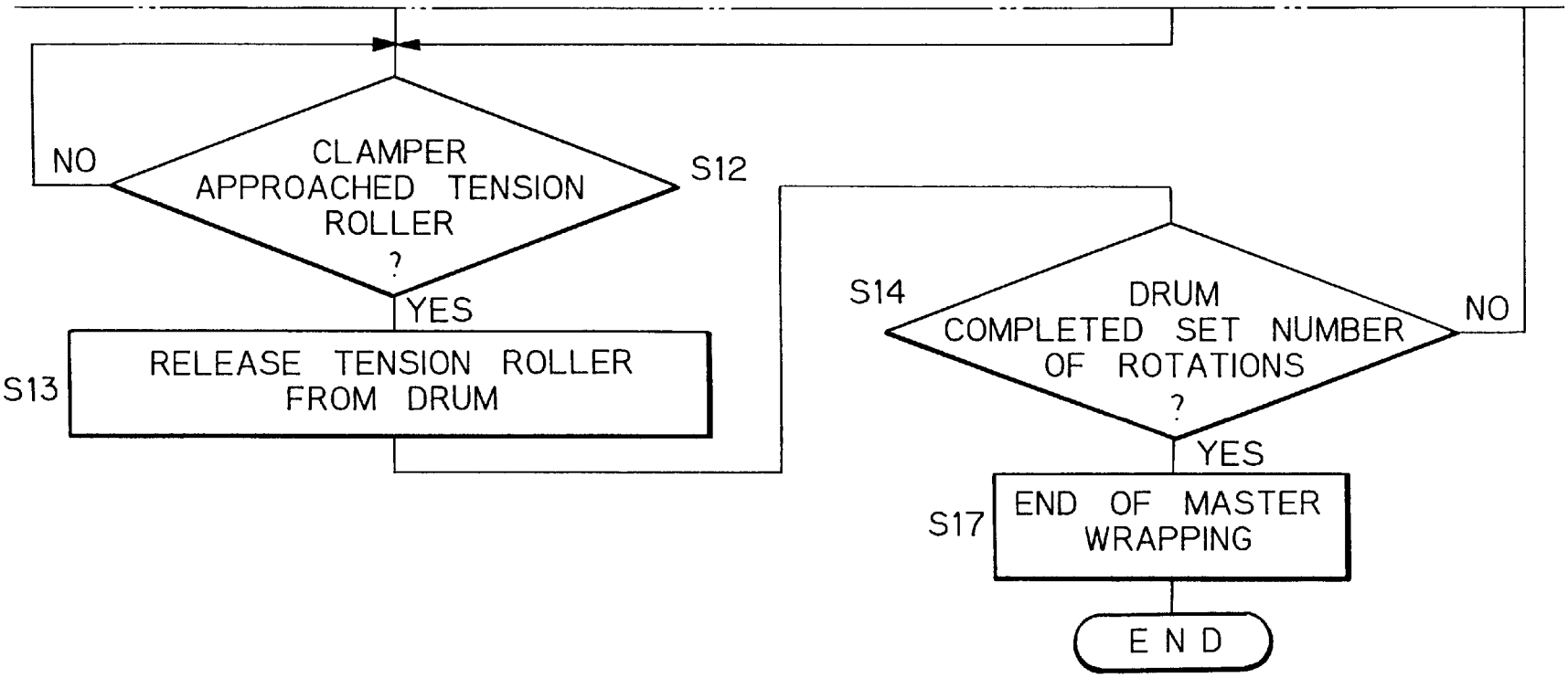

Referring to FIG. 7, a specific operation of the above embodiment will be described. As shown, when the perforation start key 66 is pressed, the CPU 54 causes the drum 2 to start rotating. When the damper 19 arrives at a position just above the drum 2, the CPU 54 stops the rotation of the drum 2 and moves the damper 19 away from the stage 18. Then, the image reading section 63 reads an image out of a document (step S1).

The CPU 54 constituting a stretch control means determines whether or not the number of rotations to be effected, i.e., the duration of the stretching operation has been input from the input section 67 (step S2). If the number of rotation has been input (Y, step S2), the CPU 54 causes the master make driver 57 to drive the thermal head 35. As a result, the heating elements of the thermal head 35 selectively generate heat in accordance with the image information read in the step S1. At the same time, the CPU 54 causes the master make driver 57 to drive the stepping motor 37, so that the stencil 1 is conveyed while being perforated by heat (step S3).

If the answer of the step S2 is negative (N), the CPU 54 determines the area of perforations to be formed in a single master 1 on the basis of the image information read in the step S1 and the image amount information stored in the ROM 68. Then, the CPU 54 computes the amount of an image to be printed on the sheet 5 on the basis of the determined area of perforations (step S4). The step S4 is executed by the previously mentioned image amount determining means.

The CPU 54 sets, based on the amount of an image determined in the step S4 and the rotation number information stored in the ROM 68, the number of rotations of the drum 2 to be effected, i.e., the duration of the stretching operation for stretching a master 1 in the widthwise direction of the master 1 (step S5). The step S5 is executed by the rotation number setting means mentioned earlier. The step S5 is followed by the step S3 for perforating the stencil by heat while conveying it.

The number of steps of drive of the stepping motor 37 after the start of the master making operation is counted. The CPU 54 determines, based on the number of steps, whether or not the leading edge of the master 1 has reached the damper 19 (step S6). The step 56 is repeated until the leading edge of the master 1 reaches the damper 19. If the answer of the step S6 is Y, the CPU 54 closes the damper 19 with the result that the leading edge of the master 1 is clamped by the damper 19 and stage 18 (step S7).

Subsequently, the CPU 54 causes the conveyor rollers 30 and 31 to stop rotating. At the same time, the CPU 54 causes the master make driver 57 to drive the suction fan 38. As a result, the master 1 is sucked into the suction box 29 while protruding upward. After the master sensor 39 has sensed the master 1 sucked into the suction box 29, the CPU 54 causes the drum 2 to rotate with the result that the master 1 is pulled out from the box 29. The rotation of the drum 2 continues until the output of the master sensor 39 indicates the absence of the master 1 in the box 29. The suction of the master 1 into the box 29 and the rotation of the drum 2 for pulling out the master 1 from the box 29 are repeated, sequentially wrapping the master 1 around the drum 2.

During the above procedure, the screen sensor 17 determines which of the screening portion 15 and notch 14 of the screen 16 faces upward, i.e., the tension rollers 4. When the output of the screen sensor 17 shows that the notch 14 faces the tension rollers 4, the CPU 54 determines that the damper 19 has not moved away from the rollers 4 yet. If the output of the sensor 17 shows that the screening portion 15 faces the tension rollers 4, the CPU 54 determines that the damper 19 has moved away from the tension rollers 4 (step S8). The step S8 is repeated until the damper 19 moves away from the tension rollers 4.

Figure 8:
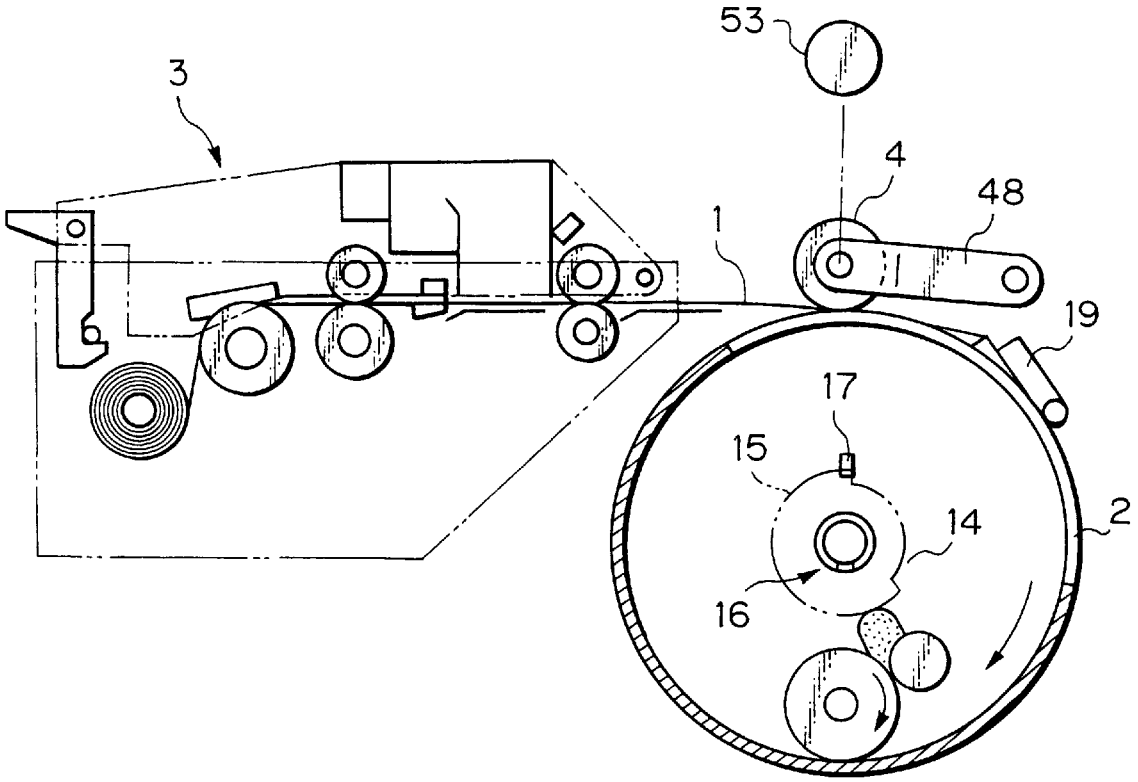
FIG. 8 is a sectional front view showing the first embodiment in operation.

When the CPU 54 determines that the damper 19 has moved away from the tension rollers 4 (Y, step S8), it drives the solenoid 51 via the solenoid driver 61. The solenoid 51 moves the lever 50 and tension roller arm 48 counterclockwise. As a result, as shown in FIG. 8, the tension rollers 4 are pressed against the drum 2 via the master 1 (step S9). Then, the CPU 54 causes the tension roller motor driver 62 to drive the motor 53. In response, the motor 53 rotates the tension rollers 4 at a higher peripheral speed than the drum 2. Consequently, the tension rollers 4 inclined with respect to the direction of master transport exerts tension on the master 1, stretching the master 1 in the widthwise direction.

The CPU 54 determines whether or not the stencil 1 has moved away from the perforating section 25 over a length corresponding to a single master (step S10). This is also done on the basis of the number of steps of drive of the stepping motor 37 counted after the start of the master making operation. If the answer of the step S10 is Y, the CPU 54 causes the cutter 28 to cut off the stencil 1 via the master make driver 57. At this instant, the CPU 54 causes the platen roller 36 and tension rollers 26 and 27 to stop rotating. As a result, the trailing edge of the cut stencil or master 1 is pulled out by the rotation of the drum 2 and wrapped around the drum 2 (step S11).

After the master 1 has been fully wrapped around the drum 2, the CPU 54 causes the drum 2 to further rotate. The screen sensor 17 is distinguishing the notch 14 and screening portion 15 of the screen 16, as stated earlier. When the screening portion 15 faces upward, as sensed by the sensor 17, the CPU 54 determines that the damper 19 is not close to the tension rollers 4. When the notch 14 faces upward, the CPU 54 determines that the damper 19 has approached the tension rollers 4. In this manner, the CPU 54 determines whether or not the damper 19 is close to the tension rollers 4 (step S12). The CPU 54 repeats the step S12 until the damper 19 approaches the tension rollers 4.

If the answer of the step S12 is Y, the CPU 54 stops energizing the solenoid 51 and thereby causes the lever 50 and tension roller arm 48 to move clockwise due to the action of the spring 52. As a result, the tension rollers 4 are released from the drum 2 (step S13). Subsequently, the CPU 54 determines whether or not the drum 2 has rotated the number of times set previously (step S14). If the answer of the step S14 is N, the CPU 54 again determines whether or not the damper 19 has moved away from the tension rollers 4 (step S15). The step S15, like the step S8, is repeated until the damper 19 moves away from the tension rollers 4.

If the damper 19 has moved away from the tension rollers 4, as determined in the step S15, the CPU 54 executes a step S 16 identical with the previously stated step S9.

The above loop including the steps S12 through S16 is repeated until the drum 2 completes the number of rotations set previously (Y, step S14). As a result, the tension rollers 4 repeatedly contact the drum 2 via the master 1 and thereby exert the tension on the the master 1, i.e., stretch the master 1 in the widthwise direction.

When the drum 2 completes the preselected number of rotations, as determined in the step S14, the CPU 54 ends the above stretching operation and causes the sheet feeding section 6 to feed one sheet 5. The CPU 54 drives the registration roller pair 42 via the sheet feed driver 58 such that the sheet 5 reaches a gap between the drum 2 and the press roller 7 in synchronism with the master 1 wrapped around the drum 2. When a sheet sensor, not shown, senses the sheet 5 conveyed by the registration roller pair 42, the CPU 54 drives the locking portion 45 via the lock driver 59 so as to unlock the press roller 7. As a result, the press roller 7 is brought into contact with the drum 2 via the sheet 5 and master 1, pressing the sheet 5 against the drum 2 via the master 1. The master 1 is therefore brought into close contact with the drum 2 (step S17).

In the step S17, the CPU 54 stops the operation of the suction fan 38 and then energizes the stepping motor 37 via the master make driver 57. As a result, the platen roller 36, tension rollers 26 and 27 and conveyor rollers 30 and 31 are rotated to convey the stencil 1 along the stencil transport path 24. As soon as the leading edge of the stencil 1 is nipped by the conveyor rollers 30 and 31, the CPU 54 causes the rollers 36, 26, 27, 30 and 31 to stop rotating.

After the step S17, the CPU 54 causes the sheet discharge driver section 60 to bring the edge of the separator 46 toward the drum 2. The separator 46 separates the sheet 5 from the drum 2. The sheet 5 separated from the drum 2 is stacked on the tray 47. The printer completed the above master making operation waits for a printing operation.

Figure 9:
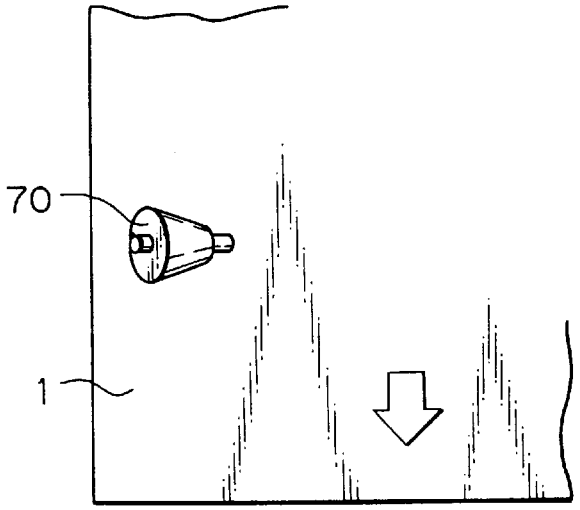
FIG. 9 is a plan view showing an alternative configuration of the tension roller included in the first embodiment.

The tension roller 4 has been shown and described as being implemented by a hollow cylindrical metallic core and a soft silicone rubber layer covering the core. Alternatively, as shown in FIG. 9, use may be made of a tension roller 70 having a frustoconical soft silicone rubber layer formed on a metallic core. The core of the tension roller 70 is inclined relative to the stencil 1 such that a generator included in the roller 70 contacts the stencil 1. If desired, soft silicone rubber may be replaced with viscous rubber cement. Further, the tension roller 4 or 70 may be provided with microsuckers on its periphery in order to suck the stencil 1.

The illustrative embodiment has concentrated on a printer of the type pressing the sheet 5 against the drum 2 so as to cause the ink to exude from the inside of the drum 2 and thereby transferring the ink to the sheet 5. The embodiment is similarly practicable with a printer of the type having an ink supply section facing the outer periphery of the drum 2, and feeding ink to the master 1 wrapped around the drum 2 from the outside of the drum 2, as taught in, e.g., Japanese Patent Laid-Open Publication No. 7-17013.

As stated above, the illustrative embodiment achieves various unprecedented advantages, as enumerated below.

(1) When a drum rotates while wrapping a master therearound, tension rollers are brought into contact with the drum via the master and caused to rotate. In this condition, the tension rollers exert tension in the directions inclined with respect to a direction of master transport. As a result, tension acts on the master in the widthwise direction of the master and thereby stretches it. In addition, because the tension rollers contact the drum via the master, the tension acts up to the trailing edge of the master. This successfully straightens the master slackened or creased even when the elasticity of the master is low. Further, because the trailing edge of the master of low elasticity is prevented from wrapping around the drum without being straightened, the master is prevented from creasing when a sheet is pressed against the drum via such a master. Creases would lower the quality of images to be printed on sheets. Moreover, it is needless to locate a device for smoothing the stencil at a position remote from the drum. This obviates tension otherwise acting on the master in the direction of master transport, and thereby frees the master from lengthwise creases even when the elasticity of the master is low.

(2) Stretch control means constituted of the CPU causes the tension rollers to repeat the above stretching operation before the drum completes a preselected number of rotations. The tension rollers therefore smooth the master wrapped around the drum a preselected number of times. This allows the master to be smoothed even when the elasticity of the master is low, and prevents such a master from slackening or creasing when a sheet is pressed against the drum via the master.

(3) The number of rotations of the drum, i.e., the period of time during which the stretching operation is effected is set by rotation number setting means on the basis of the amount of an image determined by image amount determining means. Assume that the master has low elasticity, and that an image to be formed in the master or stencil is broad. Then, the stencil undergoes a great amount of contraction when performed by heat. In such a case, the number of rotation of the drum mentioned above is increased in order to surely prevent the master of low elasticity from creasing. Conversely, when the amount of an image, i.e., the area of perforations to be formed in the stencil is small, the contraction of the stencil ascribable to heat is small. In this case, the master can be smoothed even when the number of rotations of the drum is reduced. This surely smooths the master in a shorter period of time.

(4) The tension rollers are each made up of a core and a member formed of a viscous or adsorptive material. Therefore, greater frictional resistance acts between the tension rollers and the master than between the drum and the master. It follows that the tension rollers can surely exert the tension on the master in the widthwise direction and surely smooth the master slackened or creased.

(5) The tension rollers are each made up of a core and a member formed of a material having a greater coefficient of friction than the drum. This also allows greater frictional resistance to act between the tension rollers and the master than between the drum and the master.

(6) Drive means causes the tension rollers to rotate at a higher peripheral speed than the drum. The tension rollers therefore exert greater tension on the master in the widthwise direction than when they simply follow the rotation of the drum. This also insures the smoothing of the master.

2nd Embodiment

Figure 10:
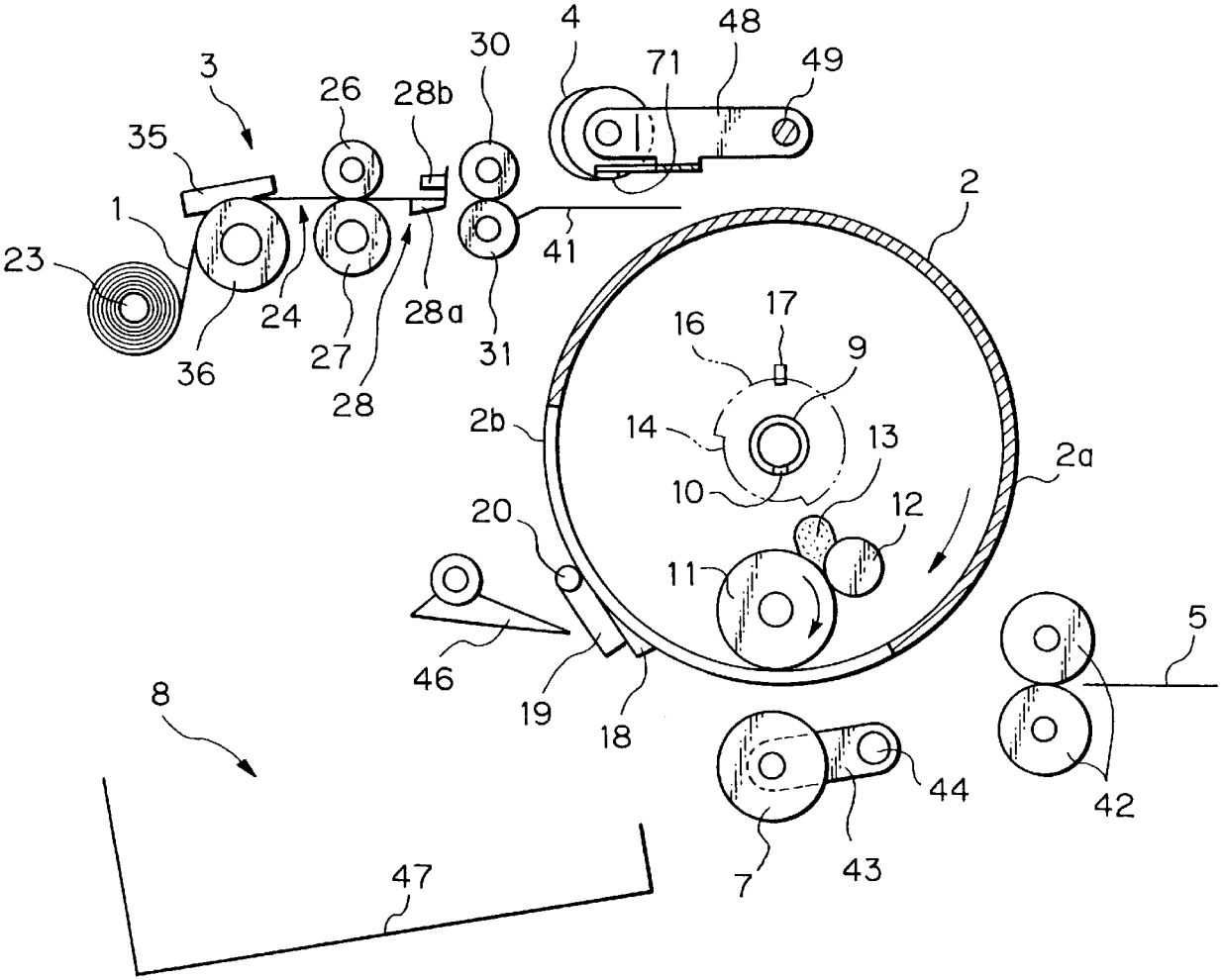
FIG. 10 is a vertical front view showing a second embodiment of the present invention.
Figure 11:
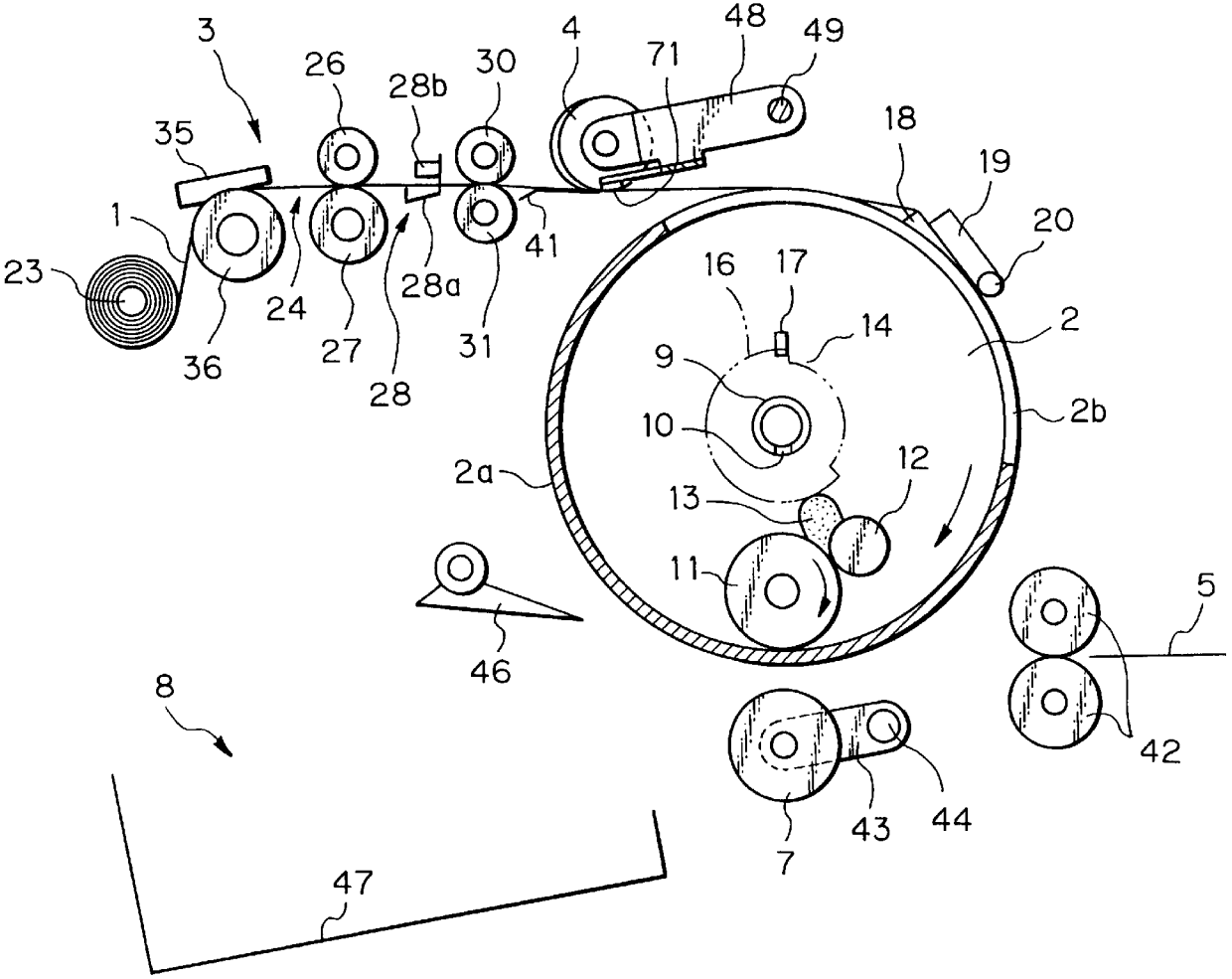
FIG. 11 is a sectional front view showing how t h e master is wrapped around the drum in the second embodiment.

Referring to FIGS. 10–14, an alternative embodiment of the present invention is shown. In FIGS. 10–14, the same or similar structural elements as or to the elements of the first embodiment are designated by the same reference numerals, and a detailed description thereof will not be made in order to avoid redundancy. As shown in FIGS. 10 and 11, the master making section 3, registration roller pair 42, press roller 7, separator 46 and sheet discharging section 8 are arranged around the drum 2, as in the previous embodiment.

In the master making section 3, the thermal head 35 is movable toward and away from the platen roller 36. The upper and lower tension rollers 26 and 27 are held in contact with each other. The cutter 28 for cutting the stencil 1 has the stationary edge 28*a* and movable edge 28*b*. The guide plate 41 sustains the stencil 1. The stencil roll 23, platen roller 36, upper and lower tension rollers 26 and 27, conveyor rollers 30 and 31 are rotatably supported by opposite side walls, not shown, included in the housing of the printer.

The thermal head 35 has a number of heating elements arranged in the main scanning direction, i.e., the direction perpendicular to the direction of master transport. A spring, not shown, constantly urges the head 35 against the platen roller 36. The lower tension roller 27 rotates at a higher peripheral speed than the platen roller 36 in order to exert tension on the master 1. However, because the tension roller 27 is connected to a drive source via a torque limiter, not shown, it is prevented from pulling the master 1 more than necessary. The conveyor rollers 30 and 31 also rotate at a higher peripheral speed than the platen roller 36. These rollers 30 and 31 rotate while slipping on the master 1, and thereby exerts a preselected degree of tension on the master 1. A stepping motor, not shown, drives the platen roller 36, upper and lower tension rollers 26 and 27 and conveyor rollers 30 and 31. As a result, the master 1 is paid out from the roll 23 and perforated by the head 35, as in the previous embodiment.

The ink supply mechanism for feeding the ink from the ink pack, not shown, to the inner periphery of the drum 2 is identical with the mechanism described with reference to FIG. 2. Again, the disk-like screen 16 including the notch 14 is affixed to one side wall of the drum 2 while the screen sensor 17 is used to sense the varying position of the screen 16 for the previously stated purpose. The stage 18 and damper 19 are mounted on the drum 2 in the same manner as in the previous embodiment.

The press roller 7 has the same configuration and is supported by the press roller arm 43 in exactly the same manner as the press roller 7 of the previous embodiment. The arm 43 is driven by a cam or the like, not shown.

The rotatable shaft 49 is positioned above the drum 2 in parallel to the axis of the drum 2. The tension roller arm 48 is affixed to the shaft 49 at one end thereof. The inclined tension rollers 4 are rotatably mounted on both sides of the other end or free end of the arm 48. An elastic member 71 is adhered to the intermediate portion of the arm 48. The tension rollers 4 are each made up of a metallic core and a layer of silicone rubber covering the core. The elastic member 71 is formed of silicone rubber, chloroprene rubber, polyurethane rubber, urethane rubber or similar solid or sponge-like material.

Figure 13:
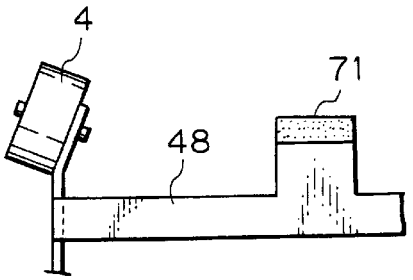
FIG. 13 is a bottom view showing a relation between an inclined tension roller and an elastic member included in the second embodiment.
Figure 14:
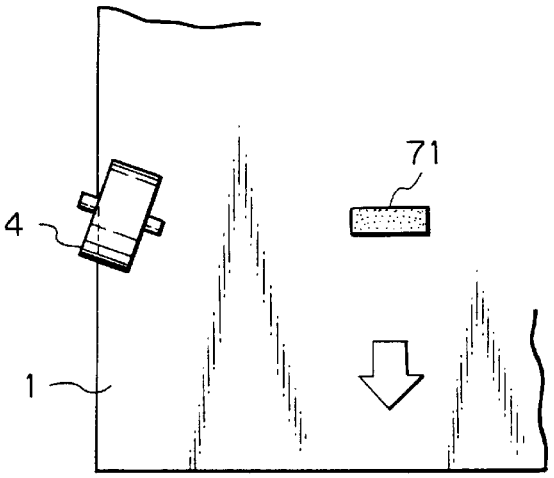
FIG. 14 is a plan view showing a position where the tension roller and elastic member of the second embodiment contact the master.

The inclined tension rollers 4 are so located as to press the opposite widthwise edges of the master 1. While the master 1 is pulled by the drum 2 being rotated, the tension rollers 4 follow the movement of the master 1 due to friction acting between them and the master 1. At this instant, the tension rollers 4 stretch the master 1 outward in the widthwise direction of the master 1 due to their inclination. Specifically, as shown in FIGS. 13 and 14, the tension rollers 4 (only one is shown) each having a cylindrical configuration are inclined away from each other from the upstream side to the downstream side in the direction of master transport (indicated by an arrow in FIG. 14).

Figure 15:
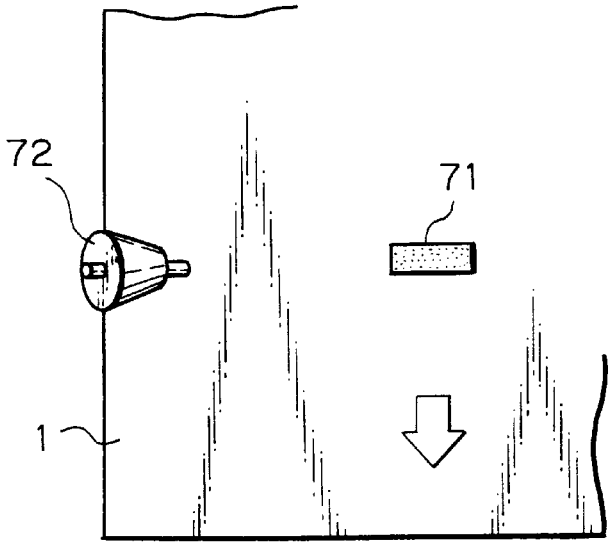
FIGS. 15 and 16 are plan views each showing a particular modification of the second embodiment.

FIG. 15 shows one of a pair of conical tension rollers 72 which may replace the cylindrical tension rollers 4. As shown, the conical tension roller 72 has its axis inclined upward from the inner end to the outer end in the widthwise direction of the stencil 1. With this configuration, the tension rollers 72 are capable of pulling the opposite side edges of the stencil 1 outward in the above direction. The elastic member 71 is positioned on a line connecting the points of the tension rollers 4 or 72 contacting the stencil 1.

Figure 12:
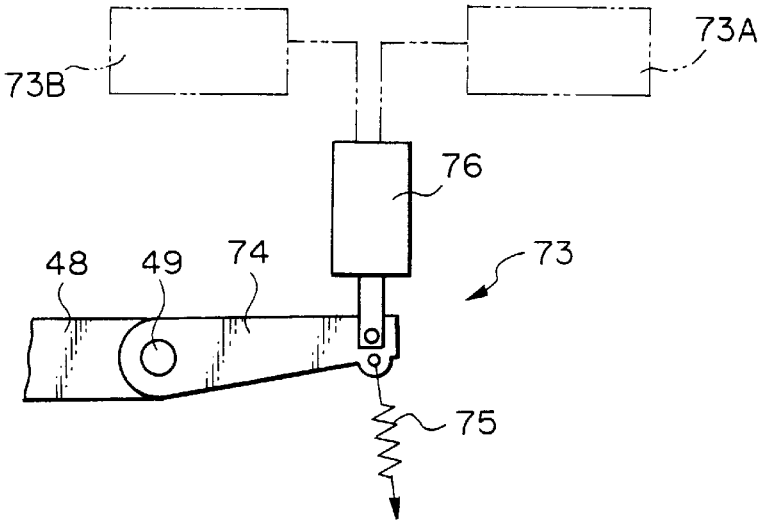
FIG. 12 is a front view of a drive mechanism included in the second embodiment.

FIG. 12 shows a drive mechanism 73 for causing the tension rollers 4 (or 72) and elastic member 71 to selectively move into or out of contact with the master 1 by rotating the shaft 49 and arm 48. As shown, a lever 74 is affixed to the shaft 49 at one end thereof. A spring 75 is anchored to the other end of the lever 74 in order to constantly bias it downward. When a solenoid 76 is energized, it causes the lever 74 to move together with the shaft 49 and arm 48 against the action of the spring 75.

In operation, assume that a document is laid on an image reading section, not shown, and then a perforation start key, for example, is pressed. In response to the resulting start signal, a motor, not shown, drives the drum 2 counterclockwise. While the drum 2 is in rotation, a master discharging device, not shown, removes a used master from the drum 2 and discards it. When the damper 19 reaches the position just above the drum 2, the rotation of the drum 2 is stopped. In this condition, the damper 19 is rotated, or opened, about the shaft 20 away from the stage 18.

An image read out of the document by the image reading section is focused onto a CCD (Charge Coupled Device) image sensor, not shown. The image sensor transforms the incident image to a corresponding electric signal or analog image data. The analog image data are digitized by an analog-to-digital converter and then sent to the thermal head 35 via a control device for controlling the master making operation. Specifically, the heating elements of the head 35 are selectively energized in accordance with the image data. At the same time, the platen roller 36, upper and lower tension rollers 26 and 27 and conveyor rollers 30 and 31 are driven to convey the master 1 toward the drum 2, as in the previous embodiment. As a result, dots representative of the document image are formed in the stencil 1.

Assume that the leading edge of the master 1 is determined to have reached the damper 19 on the basis of the number of steps of drive of the stepping motor. Then, an opening/closing device, not shown, closes the damper 19 with the result that the leading edge of the master 1 is nipped by the damper 19 and stage 18. Subsequently, the drum 2 is rotated at a peripheral speed substantially equal to the speed at which the master 1 is conveyed. Consequently, the master 1 is wrapped around the drum 2, as shown in FIG. 11.

When the drum 2 is further rotated clockwise while wrapping the master 1 therearound, the screen 16 obstructs the optical path of the screen sensor 17, as shown in FIG. 11. The solenoid 76 is energized on the basis of the resulting output of the screen sensor 17. The solenoid 76 causes the lever 74 to move counterclockwise together with the shaft 4 9 and tension roller arm 48. As a result, the inclined tension rollers 4 (or 72) and elastic member 71 press the master 1 against the guide plate 41. While the tension rollers 4 (or 72) are rotated by the master 1 due to friction acting therebetween, they pull the opposite side edges of the master 1 outward due to their inclination. At the same time, the elastic member 71 presses the intermediate portion of the master 1. In this manner, the tension rollers 4 (or 72) and elastic member 71 cooperate to smooth the master 1 even when the master is creased or waving.

When the master making operation completes, as determined on the basis of the number of steps of drive of the stepping motor, the drive transmission to the platen roller 36, upper and lower tension rollers 26 and 27, and conveyor rollers 30 and 31 is stopped. At the same time, the movable edge 28*b* of the cutter 28 is driven to cut off the master 1 in cooperation with the stationary edge 28*a*. When the trailing edge of the master 1 passes the tension rollers 4 and elastic member 71, the angular position of the drum 2 is determined on the basis of the output of the screen sensor 17 responsive to the screen 16. In response to the output of the sensor 17, the solenoid 76, FIG. 12 is deenergized with the result that the lever 74, shaft 49 and arm 48 are moved clockwise due to the action of the spring 75. Consequently, the tension rollers 4 and elastic member 71 are released from the master 1.

After the master 1 has been fully wrapped around the drum 2, the sheet 5 stopped by the registration roller pair 42 is again driven by the roller pair 42 toward the drum 2 at the previously stated timing. When the sheet sensor senses the sheet 5 reached a preselected position, the cam urges the arm 43 upward until the press roller 7 presses the sheet 5 against the porous portion 2*a* of the drum 2. Consequently, the ink is transferred from the drum 2 to the sheet 5 via the master 1 Subsequently, the separator 46 is moved toward the drum 2 s o as to separate the sheet or printing 5 from the drum 2. The printing 5 separated from the drum 2 is stacked in the tray 47.

In parallel with the above printing operation, the platen roller 36, upper and lower tension rollers 26 and 27, and conveyor rollers 30 and 31 are driven to pull the stencil 1 until its leading edge reaches the nip between the rollers 30 and 31. In this condition, the master making section 3 waits for the next operation of the perforation start key.

As stated above, while the master 1 is wrapped around the drum 2, it has its opposite side edges pulled outward by the inclined tension rollers 4 while having its intermediate portion flattened by the elastic member 71. Because the elastic member 71 is positioned on the line connecting the points of the tension rollers 4 contacting the master 1, the master 1 passes the elastic member 71 when passing the tension rollers 4 without fail. Otherwise, the master 1 would have its intermediate portion pressed by the elastic member 71 while having its side edges left free. Stated another way, in the embodiment, the elastic member 71 flattens the intermediate portion of the master 1 only when the tension rollers 4 pull the side edges of the master 1 outward. This surely smooths the master 1 even when the master 1 has low elasticity. Therefore, the master 1 wrapped around the drum 2 is free from creases and waving and produces attractive printings.

Figure 16:
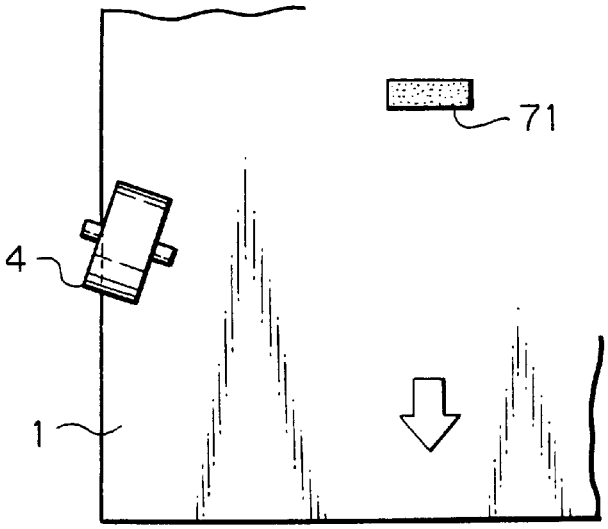

A reference will be made to FIG. 16 for describing a first modification of the second embodiment. As shown, the elastic member 71 is located at a position facing the intermediate portion of the master 1 in the widthwise direction of the master 1, but deviated from a line connecting the points of the inclined tension rollers 4 (only one is shown) contacting the master 1 to the side opposite to the drum 2 side, i.e., in the direction opposite to the direction indicated by an arrow. In this condition, even after the master 1 has moved away from the elastic member 71, its opposite ends are pulled outward by the tension rollers 4. Stated another way, the master I has already moved away from the elastic member 71 when it arrives at the tension rollers 4. This obviates an occurrence that only the intermediate portion of the master 1 is pressed by the elastic member 71 despite that the side edges of the leading edge portion of the master 1 have been released from the tension rollers 4. Consequently, the intermediate portion of the master 1 is free from creases ascribable to the conventional arrangement shown in FIG. 1.

In a second modification, the inclined tension rollers 4 and elastic member 71 are located in the vicinity of the drum 2. This reduces the length of the portion of the master 1 not wrapped around the drum 2 when the master 1 has moved away from the tension rollers 4 and elastic member 71. As a result, the master 1 is prevented from behaving undesirably at the time when it is released from the tension rollers 4 and elastic member 71. Therefore, the master 1 can be smoothly wrapped around the drum 2 in a flat position without any crease or waving.

A third modification additionally includes an intermittent control section 73A (see FIG. 12) for controlling the drive mechanism 73. The drive mechanism 73 causes the tension rollers 4 and elastic member 71 to contact the master 1 a plurality of consecutive times while the master 1 is sequentially wrapped around the drum 2, as stated earlier. The third modification pays attention to the fact that the length of the master 1 conveyed can be determined in terms of the number of steps of drive of the stepping motor for driving various rollers including the platen roller 36, as described previously. The intermittent control section 73A plays the role of control means for deenergizing, while the stepping motor is in rotation, the solenoid 76, FIG. 12, for a moment when the number of steps reaches a preselected number. However, control means other than the intermittent control section 73A may be used so long as it energizes the solenoid 76 intermittently.

In the third modification, when the master 1 is wrapped around the drum 2, the tension rollers 4 and elastic member 71 act on the master 1 as loads. As a result, tension acts on the master 1 between the tension rollers 4 and elastic member 71 and the drum 2. However, because the solenoid 76 is energized intermittently, the tension rollers 4 and elastic member 7 move away from the master 1 intermittently.

Therefore, even when the master 1 is locally extended, it is restored to its original position when released from the tension rollers 4 and elastic member 71. This prevents the master 1 from being wrapped around the drum 1 in its extended position and thereby insures printings faithful to a document.

A fourth modification additionally includes a release timing control section 73B (see FIG. 12). The release timing control section 73B controls the drive mechanism 73 such that just before the trailing edge of the master 1 clamped at its leading edge on the drum 2 moves away from the tension rollers 4 and elastic member 71, the rollers 4 and member 71 are released from the master 1. The control section 73B recognizes, also based on the number of steps of drive of the stepping motor, the time when the trailing edge of the master 1 cut off is about to move away from the tension rollers 4 and elastic member 71. Then, the control section 73B deenergizes the solenoid 76 for a moment. The control section 73B is only illustrative and may be replaced with any other suitable control means.

In the fourth modification, even when the trailing edge portion of the master 1 is inclined or conveyed askew, the tension rollers 4 are released from the master 1 at the same time just before the trailing edge portion passes the rollers 4. As a result, there can be eliminated an occurrence that only one of the rollers 4 acts on the trailing edge portion of the master 1 passing the rollers 4; that is, the loads acting on the opposite side edges of the master 1 are the same. This prevents the master 1 from creasing only at one side thereof due to slackening. Moreover, the fourth modification simplifies a production line because the tension rollers 4 do not have to be accurately positioned on a line perpendicular to the direction of stencil transport.

Figure 17:
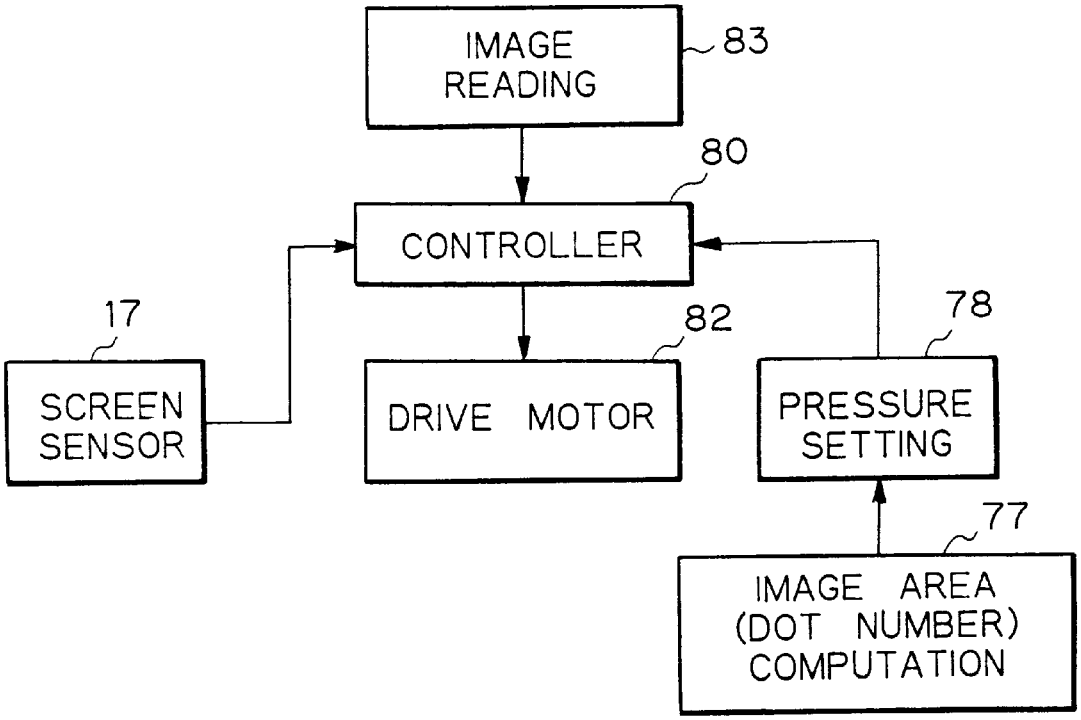
FIG. 17 is a block diagram schematically showing an electric circuit representative of a different modification o f the second embodiment.

FIG. 17 shows a fifth modification of the second embodiment. As shown, the modification additionally includes an image area computation 77 for determining the size of an image area. A pressure setting 78 sets, based on the determined size of an image area, a pressure with which the inclined tension rollers 4 and elastic member 71 should press the master 1. A controller 80 controls a drive mechanism, which will be described, on the basis of the pressure set by the pressure setting 78. The image area computation 77 computes the number of perforations or dots formed in the master 1 on the basis of a scanned image or image data input from the outside and temporarily stored in a bit map memory. The pressure setting 78 is implemented as a table listing the numbers of dots to be formed in the master 1 and the rotation angles of a drive motor 82, which will be described, corresponding to the number of dots. The controller 80 drives the motor 82 assigned to the above drive mechanism on the basis of the output of the pressure setting or table 78. An image reading 83, the previously stated screen sensor 17 and the reversible motor 82 are also connected to the control 80.

Figure 18:
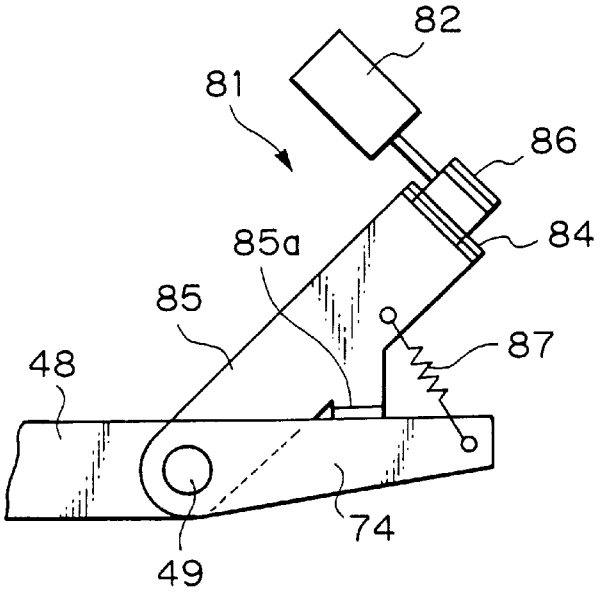
FIG. 18 is a front view of a drive mechanism included in the different modification of the second embodiment.

As shown in FIG. 18, the drive mechanism, generally 81, rotates the shaft 49 and arm 48 so as to selectively move the inclined tension rollers 4 and elastic member 71 into or out of contact with the master 1. The drive mechanism 81 has, in addition to the arm 48, shaft 49 and lever 74, a worm arm 85, worm wheel 86, and a spring 87. The worm arm 85 is freely rotatable about the shaft 49 at one end and formed with a worm 84 at the other end. The worm wheel 86 is directly connected to the drive motor 82 and held in mesh with the worm 84. The spring 87 is anchored to the worm arm 85 at one end and to the lever 74 at the other end. The worm arm 85 includes a bent portion 85*a* for pressing the lever 74 in the event of clockwise rotation.

The controller 80 controls the drive mechanism 81 on the basis of the pressure set by the pressure setting 78.

Specifically, the controller 80 controls the rotation angle of the motor 82 on the basis of the size of an image.

The fifth modification with the above construction will be operated as follows. When the leading edge of the master 1 is determined to have reached the damper 19, the opening/closing device closes the damper 19. The damper 19 nips the leading edge of the master 1 in cooperation with the stage 18. Subsequently, the drum 2 is rotated at a peripheral speed substantially equal to the speed at which the master 1 is conveyed, sequentially wrapping the master 1 therearound.

When the drum 2 is further rotated clockwise while wrapping the master 1 therearound, the screen 16 obstructs the optical path of the screen sensor 17, as shown in FIG. 11.

In response to the resulting output of the sensor 17, the controller 80 rotates the motor 82 in one direction. In this case, the worm arm 85 rotates the shaft 49 counterclockwise, as viewed in FIG. 18, while pulling the spring 87. As a result, the lever 74 rotates counterclockwise together with the shaft 49 and arm 48, causing the tension rollers 4 and elastic member 71 to press the master 1 against the guide plate 41. The tension rollers 4 and elastic member 71 operate in the manner described previously.

The time when the trailing edge of the master 1 wrapped around the drum 2 moves away from the tension rollers 4 can be determined in terms of the rotation angle of the screen 16 being sensed by the screen sensor 17. At this time, the controller 80 reverses the rotation of the motor 82 and thereby causes the worm arm 85 to rotate clockwise, as viewed in FIG. 18. As a result, the bent portion 85*a* of the worm arm 85 presses the lever 74 and causes it to rotated clockwise together with the shaft 49 and arm 48. Consequently, the tension rollers 4 and elastic member 71 are released from the master 1.

The rotation angle of the worm arm 85 in the counter-clockwise direction is variable by controlling the rotation angle of the motor 82. This allows the pressure of the tension rollers 4 and elastic member 71 acting on the master 1 to be adjusted. In this modification, the presser setting 78 sets a pressure to be exerted by the rollers 4 and member 71 on the master 1 on the basis of the size of an image area determined by the image area decision 77. Then, the controller 80 drives the motor 82 of the drive mechanism 81 on the basis of the pressure set. Therefore, despite that the elasticity of the master 1 depends on the size of an image area, the master 1 is free from unusual extension because the pressure of the rollers 4 and member 71 is adjustable. This insures printings faithful to the document.

As stated above, the second embodiment and its modifications achieve the following advantages.

(1) While a master is wrapped around a drum, it has its opposite side edges pulled outward by inclined tension rollers while having its intermediate portion pressed by an elastic member. Because the elastic member is positioned on a line connecting the points of the tension rollers contacting the master, the master passes the elastic member when passing the tension rollers without fail. Otherwise, the master would have its intermediate portion pressed by the elastic member while having its side edges left free. Stated another way, the elastic member flattens the intermediate portion of the master only when the tension rollers pull the side edges of the master outward. This surely smooths the master even when the master has low elasticity. Therefore, the master wrapped around the drum is free from creases and waving and produces attractive printings.

(2) Even after the master has moved away from the elastic member, its opposite edges are pulled outward by the tension rollers. Stated another way, the master has already moved away from the elastic member when it arrives at the tension rollers. This obviates an occurrence that only the intermediate portion of the master is pressed by the elastic member despite that the side edges of the leading edge portion of the master have been released from the tension rollers. Consequently, the intermediate portion of the master is free from creases ascribable to a conventional arrangement.

(3) The length of the portion of the master not wrapped around the drum when the master has moved away from the tension rollers and elastic member is reduced. As a result, the master is prevented from behaving undesirably at the time when it is released from the tension rollers and elastic member. Therefore, the master can be smoothly wrapped around the drum in a flat position without any crease or waving.

(4) When the master is wrapped around the drum, the tension rollers and elastic member act on the master as loads. As a result, tension acts on the master between the tension rollers and elastic member and the drum. However, the tension rollers and elastic member move away from the master intermittently. Therefore, even when the master is locally extended, it is restored to its original position when released from the tension rollers and elastic member. This prevents the master from being wrapped around the drum in its extended position and thereby insures faithful printings.

(5) Even when the trailing edge portion of the master is inclined or conveyed askew, the tension rollers are released from the master at the same time just before the tailing edge portion passes the rollers. As a result, there can be obviated an occurrence that only one of the rollers acts on the trailing edge portion of the master passing the rollers; that is, the loads acting on the opposite side edges of the master are the same. This prevents the master from creasing only at one side thereof due to slackening. Moreover, a production line is simplified because the tension rollers do not have to be accurately positioned on a line perpendicular to the direction of stencil transport.

(6) Despite that the elasticity of the master depends on the size of an image area, the master is free from unusual extension because the pressure of the tension rollers and elastic member is adjustable. This insures printings faithful to the document.

Various modifications will become possible for those skilled in the art after receiving the teachings of the present disclosure without departing from the scope thereof. For example, in the illustrative embodiments and modifications, the ink is transferred from the inside of the drum 2 to the sheet 5 via the porous portion 2*a* of the drum 2 and the perforations of the master 1. Alternatively, a master formed with a non-through dot pattern may be wrapped around a drum and supplied with ink from the outside of the drum, in which case the ink will be transferred from the non-through dot pattern to a sheet, as taught in, e.g., Japanese Patent Laid-Open Publication No. 7-17013 mentioned earlier. If desired, the master with such a non-through dot pattern may be replaced with a master with a through dot pattern.

What is claimed is:

1. A printer for printing an image on a sheet, comprising:

a rotatable drum around which a perforated master is adapted to be wrapped, the sheet being fed so as to overlap the master wrapped around said drum to transfer ink to the sheet; and a pair of tension rollers rotatable around axes respectively and adapted to be in contact with the master on said drum at opposite sides along a width of the master, said pair of tension rollers being inclined with respect to a transport direction of the master such that a distance between said pair of tension rollers increases along the transport direction, a drive mechanism for selectively moving said tension rollers to a first position where said pair of tension rollers are in contact with the master on said drum and to a second position where said pair of tension rollers are apart from said drum.

2. A printer as claimed in claim 1, further comprising:

a stretch controller which causes a stretching operation in which said pair of tension rollers rotate in contact with said drum via the master whereby the master is stretched along the width of the master.

3. A printer as claimed in claim 2, further comprising:

an image amount determining device which determines an amount of an image to be printed on the sheet; and a rotation number setting device which sets, based on the amount of the image determined by said image amount determining device, a number of rotations of said drum which represents a period of time during which said stretching operation is caused.

4. A printer as claimed in claim 1, wherein each of said pair of tension rollers comprises a core and a member covering said core and having viscosity or adsorbability.

5. A printer as claimed in claim 1, wherein each of said pair of tension rollers comprises a core and a member covering said core and having a friction coefficient greater than that of said drum.

6. A printer as claimed in claim 1, further comprising:

a driving device which rotates said pair of tension rollers at a peripheral speed higher than that of said drum.

7. A printer for printing an image on a sheet, comprising:

a rotatable drum around which a perforated master is adapted to be wrapped, the sheet being fed so as to overlap the master wrapped around said drum to transfer ink to the sheet;

a pair of tension rollers adapted to be rotated around axes respectively by a movement of the master via a friction between said pair of tension rollers and the master, said pair of tension rollers being adapted to be in contact with the master at opposite sides along a width of the master, said pair of tension rollers being inclined with respect to a transport direction of the master such that a distance between said pair of tension rollers increases along the transport direction thereby the master is stretched along the width of the master;

an elastic member positioned between said pair ol tension rollers, on a line connecting points at which said pair of tension rollers and the master contact or upstream along the transport direction of the master with respect to said line, and on a same side of said pair of tension rollers with respect to the master; and a drive mechanism which moves said pair of tension rollers and said elastic member selectively to a first position where said pair of tension rollers and said elastic member are in contact with the master and to a second position where said pair of tension rollers and said elastic member are apart from the master.

8. A printer as claimed in claim 7, wherein said pair of tension rollers and said elastic member adjoin said drum.

9. A printer as claimed in claim 7, further comprising:

an intermittent controller which causes said pair of tension rollers and said elastic member to contact with the master plural times while the master is wrapped around said drum.

10. A printer as claimed in claim 7, further comprising:

a release timing controller which controls said drive mechanism such that said pair of tension rollers and said elastic member are moved to said second position just before a trailing edge of the master passes through said pair of tension rollers.

11. A printer as claimed in claim 7, further comprising:

an image area determining device which determines a size of an image area;

a pressure setter which sets, based on the image area determined by said image area determining device, a pressure applied to the master by said pair of tension rollers and said elastic member; and a driving controller which drives said drive mechanism on the basis of the pressure set by said pressure setter.

* * * * *

UNITED STATES PATENT AND TRADEMARK OFFICE

CERTIFICATE OF CORRECTION

PATENT NO. : 5,953,985

DATED : September 21, 1999

INVENTOR(S) : Kazuyoshi KOBAYASHI

It is certified that error appears in the above-identified patent and that said Letters Patent is hereby corrected as shown below:

On the Title Page:

Abstract, line 2, delete "o f" and insert --of--.

Column 1, line 56, delete "t o" and insert --to--.

Column 4, line 1, delete "t h e" and insert --the--.

Column 5, line 12, change "irk" to --ink--;

line 35, change "damper" to --clamper--; and last line, after "portion" insert --.-- and start a new paragraph with "The perforating section 25 has a thermal...".

Column 7, line 45, change "damper" to --clamper--.

Column 8, lines 23, 25, 63, 65 and 67, change "damper" to --clamper--.

Column 9, lines 18, 21, 23, 26, 55, 57, 59 and 61, change "damper" to --clamper--.

Column 10, lines 3, 5 and 6, change "damper" to --clamper--.

Column 12, line 4, delete "t o" and insert --to--; and line 43, change "damper" to --clamper--.

UNITED STATES PATENT AND TRADEMARK OFFICE

CERTIFICATE OF CORRECTION

PATENT NO. : 5,953,985

DATED : September 21, 1999

INVENTOR(S) : Kazuyoshi KOBAYASHI

It is certified that error appears in the above-identified patent and that said Letters Patent is hereby corrected as shown below:

Column 13, lines 32, 49, 51 and 53, change "damper" to --clamper--.

Column 16, lines 53 and 54, change "damper" to --clamper--.

Signed and Sealed this

Tenth Day of April, 2001

*Attest:*

Nicholas P. Godici

NICHOLAS P. GODICI

*Attesting Officer*

*Acting Director of the United States Patent and Trademark Office*